US007619591B1

(12) United States Patent
Guy et al.

(10) Patent No.: US 7,619,591 B1
(45) **Date of Patent: *Nov. 17, 2009**

(54) ADDRESSING AND SUSTAINING OF PLASMA DISPLAY WITH PLASMA-SHELLS

(75) Inventors: Jeffery W. Guy, Toledo, OH (US); Carol Ann Wedding, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 630 days.

This patent is subject to a terminal disclaimer.

(21) Appl. No.: 11/208,745

(22) Filed: Aug. 23, 2005

Related U.S. Application Data

(63) Continuation-in-part of application No. 09/878,953, filed on Jun. 13, 2001, now Pat. No. 6,985,125, which is a continuation-in-part of application No. 09/774,055, filed on Jan. 31, 2001, now abandoned, which is a continuation-in-part of application No. 09/643,843, filed on Aug. 23, 2000, now abandoned, which is a continuation-in-part of application No. 09/556,337, filed on Apr. 24, 2000, now abandoned, application No. 11/208,745, which is a continuation-in-part of application No. 10/431,446, filed on May 8, 2003.

(60) Provisional application No. 60/131,177, filed on Apr. 26, 1999, provisional application No. 60/381,822, filed on May 21, 2002.

(51) Int. Cl.
*G09G 3/28* (2006.01)

(52) U.S. Cl. ..... 345/68

(58) Field of Classification Search ..... 345/66, 345/37, 60, 68

See application file for complete search history.

(56) References Cited

U.S. PATENT DOCUMENTS 2,644,113 A 6/1953 Etzkorn (Continued)

FOREIGN PATENT DOCUMENTS

EP 1 020 838 A1 7/2000

(Continued)

OTHER PUBLICATIONS

J. Ryeom et al, High-Luminance and High-Contrast HDTV PDP with Overlapping Driving Scheme, pp. 743 to 746, *Proceedings of the Sixth International Display Workshops*, IDW 99, Dec. 1-3, 1999, Sendai, Japan.

(Continued)

*Primary Examiner*—Amr Awad
*Assistant Examiner*—Liliana Cerullo
(74) *Attorney, Agent, or Firm*—Donald K. Wedding

(57) ABSTRACT

The simultaneous addressing and sustaining of an AC plasma display panel comprised of a multiplicity of Plasma-shells with the display divided into a plurality of Plasma-shell sections $S_1$, $S_2$, $S_n$. The Plasma-shells in at least one section of the panel are addressed while the Plasma-shells in at least one other section of the panel are simultaneously sustained. A reset voltage is simultaneously applied to all of the Plasma-shells in each section before the addressing of Plasma-shells in one section and the simultaneous sustaining of Plasma-shells in another section. Plasma-shell includes Plasma-sphere, Plasma-disc, and Plasma-dome.

16 Claims, 17 Drawing Sheets

U.S. PATENT DOCUMENTS 3,050,654 A 8/1962 Toulon
3,499,167 A 3/1970 Baker et al. ..... 315/169
3,559,190 A 1/1971 Bitzer et al. ..... 340/173
3,602,754 A 8/1971 Pfaender et al.
3,603,836 A 9/1971 Grier ..... 313/201
3,654,680 A 4/1972 Bode et al.
3,801,861 A 4/1974 Petty et al. ..... 315/169 TV
3,803,449 A 4/1974 Schmersal ..... 315/169 TV
3,848,248 A 11/1974 MacIntyre
3,927,342 A 12/1975 Bode et al.
3,969,718 A 7/1976 Strom
3,990,068 A 11/1976 Mayer et al.
3,998,618 A 12/1976 Kreick et al.
4,027,188 A 5/1977 Bergman
4,035,690 A 7/1977 Roeber
4,038,577 A 7/1977 Bode et al.
4,044,349 A * 8/1977 Andoh et al. ..... 345/61
4,063,131 A 12/1977 Miller ..... 315/169 TV
4,087,805 A 5/1978 Miller ..... 340/324 M
4,087,807 A 5/1978 Miavecz ..... 340/324 M
4,130,779 A 12/1978 Miller et al.
4,233,623 A 11/1980 Pavliscak ..... 358/59
4,320,418 A 3/1982 Pavliscak ..... 358/240
4,611,203 A 9/1986 Criscimagna et al. ..... 340/773
4,683,470 A 7/1987 Criscimagna et al. ..... 340/771
4,963,792 A 10/1990 Parker
5,326,298 A 7/1994 Hotomi
5,446,344 A 8/1995 Kanazawa ..... 315/169.4
5,541,618 A 7/1996 Shinoda ..... 345/60
5,661,500 A 8/1997 Shinoda et al. ..... 345/60
5,663,741 A 9/1997 Kanazawa
5,674,553 A 10/1997 Shinoda et al. ..... 427/68
5,724,054 A 3/1998 Shinoda ..... 345/60
5,736,815 A 4/1998 Amemiya ..... 313/586
5,745,086 A * 4/1998 Weber ..... 345/63
5,786,794 A 7/1998 Kishi et al.
5,793,158 A 8/1998 Wedding, Sr. ..... 313/483
5,828,356 A 10/1998 Stoller ..... 345/60
5,914,563 A 6/1999 Lee et al. ..... 206/750
5,952,782 A 9/1999 Nanto et al.
5,984,747 A 11/1999 Bhagavatula et al.
6,034,657 A 3/2000 Tokunaga et al. ..... 345/60
6,072,447 A * 6/2000 Noborio ..... 345/60
6,097,358 A 8/2000 Hirakawa et al. ..... 345/63
6,198,476 B1 3/2001 Hong et al. ..... 345/204
6,208,081 B1 3/2001 Eo et al. ..... 315/169.1
6,255,777 B1 7/2001 Kim et al.
6,288,693 B1 * 9/2001 Song et al. ..... 345/68
6,310,588 B1 * 10/2001 Kawahara et al. ..... 345/63
RE37,444 E 11/2001 Kanazawa
6,489,939 B1 12/2002 Asao et al.
6,498,593 B1 12/2002 Fujimoto et al.
6,531,819 B1 3/2003 Nakahara et al.
6,545,422 B1 * 4/2003 George et al. ..... 315/169.3
6,559,814 B1 5/2003 Kanazawa et al.
6,570,335 B1 5/2003 George et al.
6,577,062 B2 6/2003 Itokawa et al.
6,603,446 B1 8/2003 Kanazawa et al.
6,612,889 B1 9/2003 Green et al.
6,620,012 B1 9/2003 Johnson et al.
6,630,790 B2 10/2003 Kanazawa et al.
6,630,916 B1 10/2003 Shinoda
6,633,117 B2 10/2003 Shinoda et al.
6,636,188 B1 10/2003 Kanazawa et al.
6,646,388 B2 11/2003 George et al.
6,650,055 B2 11/2003 Ishimoto et al.
6,653,993 B1 11/2003 Nagao et al.
6,667,579 B2 12/2003 Kanazawa et al.
6,667,728 B2 12/2003 Kanazawa et al.
6,677,704 B2 1/2004 Ishimoto et al.
6,703,792 B2 3/2004 Kawada et al.
6,738,033 B1 5/2004 Hibino et al.
6,762,566 B1 7/2004 George et al.
6,764,367 B2 7/2004 Green et al.
6,791,264 B2 9/2004 Green et al.
6,794,812 B2 9/2004 Yamada et al.
6,796,867 B2 9/2004 George et al.
6,801,001 B2 10/2004 Drobot et al.
6,822,626 B2 11/2004 George et al.
6,836,063 B2 12/2004 Ishimoto et al.
6,836,064 B2 12/2004 Yamada et al.
6,841,929 B2 1/2005 Ishimoto et al.
6,857,923 B2 2/2005 Yamada et al.
6,893,677 B2 5/2005 Yamada et al.
6,900,598 B2 5/2005 Hibino et al.
6,902,456 B2 6/2005 George et al.
6,914,382 B2 7/2005 Ishimoto et al.
6,985,125 B2 * 1/2006 Velayudhan et al. ..... 345/60
2001/0028216 A1 10/2001 Tokai et al.
2002/0017863 A1 2/2002 Kim et al.
2002/0047584 A1 * 4/2002 Rutherford ..... 315/169.4
2003/0025451 A1 2/2003 Yamada et al.
2003/0122485 A1 7/2003 Tokai et al.
2003/0160742 A1 8/2003 Sakita
2003/0164684 A1 9/2003 Green et al.
2003/0182967 A1 10/2003 Tokai et al.
2003/0207643 A1 11/2003 Wyeth et al.
2003/0214224 A1 11/2003 Awamoto et al.
2004/0004445 A1 1/2004 George et al.
2004/0033319 A1 2/2004 Yamada et al.
2004/0046509 A1 3/2004 Sakita
2004/0063373 A1 4/2004 Johnson et al.
2004/0106349 A1 6/2004 Green et al.
2004/0152389 A1 8/2004 Tokai et al.
2004/0166762 A1 8/2004 Green et al.
2004/0189549 A1 9/2004 Sakita
2005/0095944 A1 5/2005 George et al.
2005/0115495 A1 6/2005 Yamada et al.

FOREIGN PATENT DOCUMENTS

WO WO 00/30065 5/2000

OTHER PUBLICATIONS

Kanazawa et al, *1999 Digest of the Society for Information Display*, pp. 154-157.
Tokunaga et al, Development of New Driving Method for AC-PDPs, *Pioneer Proceedings of the Sixth International Display Workshops*, IDW 99, pp. 787-790, Dec. 1-3, 1999, Sendai, Japan.

* cited by examiner

1 SUSTAIN PHASE

2 PRIMING PHASE FOR RAMP RESET

3 UP RAMP RESET

K - IDLE TIME BEFORE NEGATIVE RAMP RESET

4 DOWN RAMP RESET

I - IDLE TIME BEFORE ADDRESSING

5 ADDRESSING

J - IDLE TIME BEFORE SUSTAINING

6 SUSTAIN PHASE

| Electrical Map | | Data Electrodes | | | | | | | | | | |
|---|---|---|---|---|---|---|---|---|---|---|---|---|
| | | l1 | l2 | l3 | l4 | l5 | l6 | l7 | l8 | l9 | | |
| | | m1 | m2 | m3 | m4 | m5 | m6 | m7 | m8 | m9 | | |
| Address Electrodes (scan electrodes) | n1 | n1,l1 | n1,l2 | n1,l3 | n1,l4 | n1,l5 | n1,l6 | n1,l7 | n1,l8 | n1,l9 | R1 | Rows |
| | n2 | n2,l1 | n2,l2 | n2,l3 | n2,l4 | n2,l5 | n2,l6 | n2,l7 | n2,l8 | n2,l9 | R2 | |
| | n3 | n3,l1 | n3,l2 | n3,l3 | n3,l4 | n3,l5 | n3,l6 | n3,l7 | n3,l8 | n3,l9 | R3 | |
| | n4 | n4,l1 | n4,l2 | n4,l3 | n4,l4 | n4,l5 | n4,l6 | n4,l7 | n4,l8 | n4,l9 | R4 | |
| | n5 | n5,m1 | n5,m2 | n5,m3 | n5,m4 | n5,m5 | n5,m6 | n5,m7 | n5,m8 | n5,m9 | R5 | |
| | n6 | n6,m1 | n6,m2 | n6,m3 | n6,m4 | n6,m5 | n6,m6 | n6,m7 | n6,m8 | n6,m9 | R6 | |
| | n7 | n7,m1 | n7,m2 | n7,m3 | n7,m4 | n7,m5 | n7,m6 | n7,m7 | n7,m8 | n7,m9 | R7 | |
| | n8 | n8,m1 | n8,m2 | n8,m3 | n8,m4 | n8,m5 | n8,m6 | n8,m7 | n8,m8 | n8,m9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R1,C2 | R1,C3 | R1,C4 | R1,C5 | R1,C6 | R1,C7 | R1,C8 | R1,C9 |
| | | R5,C1 | R5,C2 | R5,C3 | R5,C4 | R5,C5 | R5,C6 | R5,C7 | R5,C8 | R5,C9 |
| | | | | | | | | | | |
| | 2 | R2,C1 | R2,C2 | R2,C3 | R2,C4 | R2,C5 | R2,C6 | R2,C7 | R2,C8 | R2,C9 |
| | | R6,C1 | R6,C2 | R6,C3 | R6,C4 | R6,C5 | R6,C6 | R6,C7 | R6,C8 | R6,C9 |

FIG. 14A

| Electrical Map | | Data Electrodes | | | | | | | | | | |
|---|---|---|---|---|---|---|---|---|---|---|---|---|
| | | m1 | m2 | m3 | m4 | m5 | m6 | m7 | m8 | m9 | | |
| Address Electrodes (scan electrodes) | n1 | n1,m1 | n3,m2 | n1,m3 | n3,m4 | n1,m5 | n3,m6 | n1,m7 | n3,m8 | n1,m9 | R1 | Rows |
| | n2 | n2,m1 | n4,m2 | n2,m3 | n4,m4 | n2,m5 | n4,m6 | n2,m7 | n4,m8 | n2,m9 | R2 | |
| | n3 | n3,m1 | n1,m2 | n3,m3 | n1,m4 | n3,m5 | n1,m6 | n3,m7 | n1,m8 | n3,m9 | R3 | |
| | n4 | n4,m1 | n2,m2 | n4,m3 | n2,m4 | n4,m5 | n2,m6 | n4,m7 | n2,m8 | n4,m9 | R4 | |
| | n5 | n5,m1 | n7,m2 | n5,m3 | n7,m4 | n5,m5 | n7,m6 | n5,m7 | n7,m8 | n5,m9 | R5 | |
| | n6 | n6,m1 | n8,m2 | n6,m3 | n8,m4 | n6,m5 | n8,m6 | n6,m7 | n8,m8 | n6,m9 | R6 | |
| | n7 | n7,m1 | n5,m2 | n7,m3 | n5,m4 | n7,m5 | n5,m6 | n7,m7 | n5,m8 | n7,m9 | R7 | |
| | n8 | n8,m1 | n6,m2 | n8,m3 | n6,m4 | n8,m5 | n6,m6 | n8,m7 | n6,m8 | n8,m9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R3,C2 | R1,C3 | R3,C4 | R1,C5 | R3,C6 | R1,C7 | R3,C8 | R1,C9 |
| | 2 | R2,C1 | R4,C2 | R2,C3 | R4,C4 | R2,C5 | R4,C6 | R2,C7 | R4,C8 | R2,C9 |
| | 3 | R3,C1 | R1,C2 | R3,C3 | R1,C4 | R3,C5 | R1,C6 | R3,C7 | R1,C8 | R3,C9 |
| | 4 | R4,C1 | R2,C2 | R4,C3 | R2,C4 | R4,C5 | R2,C6 | R4,C7 | R2,C8 | R4,C9 |

FIG. 14B

| Electrical Map | | Data Electrodes | | | | | | | | | | |
|---|---|---|---|---|---|---|---|---|---|---|---|---|
| | | m1 | m2 | m3 | m4 | m5 | m6 | m7 | m8 | m9 | | |
| Address Electrodes (scan electrodes) | n1 | n1,m1 | n4,m2 | n3,m3 | n2,m4 | n1,m5 | n4,m6 | n3,m7 | n2,m8 | n1,m9 | R1 | Rows |
| | n2 | n2,m1 | n1,m2 | n4,m3 | n3,m4 | n2,m5 | n1,m6 | n4,m7 | n3,m8 | n2,m9 | R2 | |
| | n3 | n3,m1 | n2,m2 | n1,m3 | n4,m4 | n3,m5 | n2,m6 | n1,m7 | n4,m8 | n3,m9 | R3 | |
| | n4 | n4,m1 | n3,m2 | n2,m3 | n1,m4 | n4,m5 | n3,m6 | n2,m7 | n1,m8 | n4,m9 | R4 | |
| | n5 | n5,m1 | n8,m2 | n7,m3 | n6,m4 | n5,m5 | n8,m6 | n7,m7 | n6,m8 | n5,m9 | R5 | |
| | n6 | n6,m1 | n5,m2 | n8,m3 | n7,m4 | n6,m5 | n5,m6 | n8,m7 | n7,m8 | n6,m9 | R6 | |
| | n7 | n7,m1 | n6,m2 | n5,m3 | n8,m4 | n7,m5 | n6,m6 | n5,m7 | n8,m8 | n7,m9 | R7 | |
| | n8 | n8,m1 | n7,m2 | n6,m3 | n5,m4 | n8,m5 | n7,m6 | n6,m7 | n5,m8 | n8,m9 | R8 | |
| | | C1 | C2 | C3 | C4 | C5 | C6 | C7 | C8 | C9 | | |
| | | Column | | | | | | | | | Physical Map | |

| | scan | Physical Map | | | | | | | | |
|---|---|---|---|---|---|---|---|---|---|---|
| | 1 | R1,C1 | R2,C2 | R3,C3 | R4,C4 | R1,C5 | R2,C6 | R3,C7 | R4,C8 | R1,C9 |
| | 2 | R2,C1 | R3,C2 | R4,C3 | R1,C4 | R2,C5 | R3,C6 | R4,C7 | R1,C8 | R2,C9 |
| | 3 | R3,C1 | R4,C2 | R1,C3 | R2,C4 | R3,C5 | R4,C6 | R1,C7 | R2,C8 | R3,C9 |
| | 4 | R4,C1 | R1,C2 | R2,C3 | R3,C4 | R4,C5 | R1,C6 | R2,C7 | R3,C8 | R4,C9 |

FIG. 14C

ADDRESSING AND SUSTAINING OF PLASMA DISPLAY WITH PLASMA-SHELLS

RELATED APPLICATIONS

This is a continuation-in-part of U.S. patent application Ser. No. 09/878,953, filed Jun. 13, 2001 now U.S. Pat. No. 6,985,125 which is a continuation-in-part under 35 U.S.C. 120 of a U.S. patent application Ser. No. 09/774,055 filed Jan. 31, 2001 now abandoned which is a continuation-in-part under 35 U.S.C. 120 of a U.S. patent application Ser. No. 09/643,843 filed Aug. 23, 2000 now abandoned which is a continuation-in-part under 35 U.S.C. 120 of U.S. patent application Ser. No. 09/556,337 filed Apr. 24, 2000 now abandoned which claims priority under 35 U.S.C. 119 (e) of Provisional Application 60/131,177 filed Apr. 26, 1999.

This application is also a continuation-in-part under 35 U.S.C. 120 of U.S. patent application Ser. No. 10/431,446, filed May 8, 2003 which claims priority under 35 U.S.C. 119(e) of Provisional Application 60/381,822 filed May 21, 2002.

INTRODUCTION

This invention relates to the Simultaneous Addressing and Sustaining (SAS) of an AC gas discharge plasma display panel (PDP) structure comprised of a multiplicity of hollow Plasma-shells filled with an ionizable gas. The Plasma-shells are placed on and/or in a substrate and electrically connected to conductors such as electrodes. In the practice of this invention, the Plasma-shell PDP display is operated by applying address voltages such as write and/or erase voltages to at least one display section of the Plasma-shell PDP while at least one other display section of the Plasma-shell PDP is being simultaneously sustained. This invention of the Simultaneous Address and Sustain (SAS) of a Plasma-shell PDP display is suitable for high resolution and high-information content applications including high definition television (HDTV).

As used herein Plasma-shell includes Plasma-sphere, Plasma-disc, and Plasma-dome. The hollow Plasma-shells may be used alone or in combination with plasma-tubes. The Plasma-shells may be used in the PDP in various combinations such as Plasma-spheres and Plasma-discs, Plasma-spheres and Plasma-domes, and Plasma-discs and Plasma-domes. There may also be used combinations of all three, Plasma-spheres, Plasma-discs, and Plasma-domes.

BACKGROUND OF THE INVENTION

PDP Structures and Operation

This invention relates to a gas discharge plasma panel (PDP) comprising one or more addressable picture elements (pixels). In a gas discharge plasma display panel, each addressable picture element is a cell, sometimes referred to as a pixel. In a multicolor PDP, two or more cells or pixels may be addressed as sub-cells or sub-pixels to form a single cell or pixel. As used herein cell or pixel means sub-cell or sub-pixel. The cell or pixel element is defined by two or more electrodes positioned in such a way so as to provide a voltage potential across a gap containing an ionizable gas. When sufficient voltage is applied across the gap, the gas ionizes to produce light. In an AC gas discharge plasma display, the electrodes at a cell site are coated with a dielectric. The electrodes are generally grouped in a matrix configuration to allow for selective addressing of each cell or pixel.

In the operation of a PDP, different voltage pulses are applied across a plasma display cell gap. These pulses include a write pulse, which is the voltage potential sufficient to ionize and discharge the gas at the pixel site. A write pulse is selectively applied across selected cell sites to cause a gas discharge at a selected cell. The gas discharge will produce visible light, UV light and/or IR light which may be used to excite a phosphor. Sustain pulses are a series of pulses that produce a voltage potential across pixels to maintain gas discharge of cells previously addressed with a write pulse. An erase pulse is used to selectively extinguish cells that are in the "on" state.

The voltage at which a pixel will discharge, sustain, and erase depends on a number of factors including the distance between the electrodes, the composition of the ionizing gas, and the pressure of the ionizing gas. Also of importance is the dielectric composition and thickness. To maintain uniform electrical and optical characteristics throughout the display it is desired that the various physical parameters adhere to required tolerances. Maintaining the required tolerance depends on cell geometry, fabrication methods, and the materials used. The prior art discloses a variety of plasma display structures, a variety of methods of construction, and a variety of materials.

The practice of this invention includes monochrome (single color) AC plasma displays and multi-color (two or more colors) AC plasma displays. Also monochrome and multicolor DC plasma displays are contemplated.

Examples of monochrome AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), and 4,126,807 (Wedding), all incorporated herein by reference.

Examples of multicolor AC plasma displays are well known in the prior art and include those disclosed in U.S. Pat. Nos. 4,233,623 ( Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber), and 5,793,158 (Wedding), all incorporated herein by reference.

This invention may be practiced in a DC gas discharge (plasma) display which is well known in the prior art, for example as disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

This invention will be described with reference to an AC plasma display. The PDP industry has used two different AC plasma display panel (PDP) structures, the two-electrode columnar discharge structure and the three-electrode surface discharge structure. Columnar discharge is also called co-planar discharge.

Columnar PDP

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate.

The columnar discharge PDP structure has been widely used in monochrome AC plasma displays that emit orange or red light from a neon gas discharge. Phosphors may be used in a monochrome structure to obtain a color other than neon orange.

In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a two electrode columnar discharge PDP as disclosed by Wedding ('158), each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge PDP

The three-electrode multi-color surface discharge AC plasma display panel structure is widely disclosed in the prior art including U.S. Pat. Nos. 5,661,500 (Shinoda et al.), 5,674,553 (Shinoda et al.), 5,745,086 (Weber), and 5,736,815 (Amemiya), all incorporated herein by reference.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

In a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor minimizes electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is subject to less electron bombardment than in a columnar discharge PDP.

Single Substrate PDP

There may be used a PDP structure having a so-called single substrate or monolithic plasma display panel structure having one substrate with or without a top or front viewing envelope or dome. Single-substrate or monolithic plasma display panel structures are well known in the prior art and are disclosed by U.S. Pat. Nos. 3,646,384 (Lay), 3,652,891 (Janning), 3,666,981 (Lay), 3,811,061 (Nakayama et et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

RELATED PRIOR ART

Spheres, Beads, Ampoules, Capsules

The construction of a PDP out of gas filled hollow microspheres is known in the prior art. Such microspheres are referred to as spheres, beads, ampoules, capsules, bubbles, shells, and so forth. The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultra violet light onto a phosphor external to the ampoule itself.

U.S. Pat. No. 3,848,248 (MacIntyre) discloses the embedding of gas filled beads in a transparent dielectric. The beads are filled with a gas using a capillary. The external shell of the beads may contain phosphor.

U.S. Pat. No. 3,998,618 (Kreick et al.) discloses the manufacture of gas filled beads by the cutting of tubing. The tubing is cut into ampoules (shown as domes in FIG. 2) and heated to form shells. The gas is a rare gas mixture, 95% neon, and 5% argon at a pressure of 300 Torr.

U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture which emits a color upon discharge and/or by using a glass shell made from colored glass.

U.S. Pat. No. 4,963,792 (Parker) discloses a gas discharge chamber including a transparent dome portion.

U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen.

Japanese Patent 11238469A, published Aug. 31, 1999, by Tsuruoka Yoshiaki of Dainippon discloses a plasma display panel containing a gas capsule. The gas capsule is provided with a rupturable part which ruptures when it absorbs a laser beam.

U.S. Pat. No. 6,545,422 (George et al.) discloses a light-emitting panel with a plurality of sockets with spherical or other shape micro-components in each socket sandwiched between two substrates. The micro-component includes a shell filled with a plasma-forming gas or other material. The light-emitting panel may be a plasma display, electroluminescent display, or other display device.

The following U.S. Patents are also issued to George et al. and the various joint inventors are incorporated herein by reference:

U.S. Pat. Nos. 6,570,335 (George et al.), 6,612,889 (Green et al.), 6,620,012 (Johnson et al.), 6,646,388 (George et al.), 6,762,566 (George et al.), 6,764,367 (Green et al.), 6,791,264

(Green et al.), 6,796,867 (George et al.), 6,801,001 (Drobot et al.), 6,822,626 (George et al.), and 6,902,456 (George et al.), Also incorporated herein by reference are the following U.S. Patent Applications filed by the various joint inventors of George et al.:

U.S. Patent Application Publication Nos. 2003/0164684 (Green et al.), 2003/0207643 (Wyeth et al.), 2004/0004445 (George et al.), 2004/0063373 (Johnson et al.), 2004/0106349 (Green et al.), 2004/0166762 (Green et al.), and 2005/0095944 (George et al.), Also incorporated by reference is U.S. Pat. No. 6,864,631 (Wedding) which discloses microspheres filled with ionizable gas and positioned in a gas discharge plasma display with phosphor.

Methods of Producing Microspheres

Numerous methods and processes to produce hollow spheres or microspheres are well known in the prior art. Microspheres have been formed from glass, ceramic, metal, plastic, and other inorganic and organic materials. Varying methods for producing spheres and microspheres have been disclosed and practiced in the prior art.

Some methods used to produce hollow glass microspheres incorporate a so-called blowing gas into the lattice of a glass while in frit form. The frit is heated and glass bubbles are formed by the in-permeation of the blowing gas. Microspheres formed by this method have diameters ranging from about 5 μm to approximately 5,000 μm. This method produces spheres with a residual blowing gas enclosed in the sphere. The blowing gases typically include $SO_2$, $CO_2$, and $H_2O$. These residual gases will quench a plasma discharge. Because of these residual gases microspheres produced with this method are not acceptable for producing Plasma-spheres for use in a PDP.

Methods of manufacturing glass frit for forming hollow microspheres are disclosed by U.S. Pat. Nos. 4,017,290 (Budrick et al.) and 4,021,253 (Budrick et al.) Budrick et al. ('290) discloses a process whereby occluded material gasifies to form the hollow microsphere.

Hollow microspheres are disclosed in U.S. Pat. Nos. 5,500,287 (Henderson) and 5,501,871 (Henderson). According to Henderson ('287), the hollow microspheres are formed by dissolving a permeant gas (or gases) into glass frit particles. The gas permeated frit particles are then heated at a high temperature sufficient to blow the frit particles into hollow microspheres containing the permeant gases. The gases may be subsequently out-permeated and evacuated from the hollow sphere as described in step D in column 3 of Henderson ('287). Henderson ('287) and ('871) are limited to gases of small molecular size. Some gases such as xenon, argon, and krypton used in plasma displays may be too large to be permeated through the frit material or wall of the microsphere. Helium which has a small molecular size may leak through the microsphere wall or shell.

Microspheres are also produced as disclosed in U.S. Pat. No. 4,415,512 (Torobin), incorporated herein by reference. This method by Torobin comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder which close and detach the elongated cylinder from the coaxial blowing nozzle. Surface tension forces acting on the detached cylinder form the latter into a spherical shape which is rapidly cooled and solidified by cooling means to form a glass microsphere.

In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference.

The microspheres may also be produced using a centrifuge apparatus and method as disclosed by U.S. Pat. No. 4,303,433 (Torobin) and WO8000695A1 (Torobin), both incorporated herein by reference.

Other methods for forming microspheres of glass, ceramic, metal, plastic, and other materials are disclosed in other Torobin patents including U.S. Pat. Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,363,646; 4,303,736; 4,303,732; 4,303,731; 4,303,603; 4,303,431; 4,303,730; 4,303,729; and 4,303,061, all incorporated herein by reference.

U.S. Pat. Nos. 3,607,169 (Coxe) and 4,303,732 (Torobin) disclose an extrusion method in which a gas is blown into molten glass and individual spheres are formed. As the spheres leave the chamber, they cool and some of the gas is trapped inside. Because the spheres cool and drop at the same time, the sphere shells do not form uniformly. It is also difficult to control the amount and composition of gas that remains in the sphere.

U.S. Pat. No. 4,349,456 (Sowman), incorporated by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried, and fired to convert them into microspheres. Prior to firing, the microcapsules are sufficiently porous that, if placed in a vacuum during the firing process, the gases can be removed and the resulting microspheres will generally be impermeable to ambient gases. The spheres formed with this method may be easily filled with a variety of gases and pressurized from near vacuums to above atmosphere. This is a suitable method for producing microspheres. However, shell uniformity may be difficult to control.

U.S. Patent Application Publication 2002/0004111 (Matsubara et al.), incorporated by reference discloses a method of preparing hollow glass microspheres by adding a combustible liquid (kerosene) to a material containing a foaming agent.

Other methods for forming microspheres are disclosed in the prior art including U.S. Pat. Nos. 4,307,051 (Sargeant et al.), 4,775,598 (Jaeckel), and 4,917,857 (Jaeckel et al.), all of which are incorporated herein by reference.

Methods for forming microspheres are also disclosed in U.S. Pat. Nos. 3,848,248 (MacIntyre), 3,998,618 (Kreick et al.), and 4,035,690 (Roeber), discussed above and incorporated herein by reference.

Methods of manufacturing hollow microspheres are disclosed in U.S. Pat. Nos. 3,794,503 (Netting), 3,796,777 (Netting), 3,888,957 (Netting), and 4,340,642 (Netting et al.), all incorporated herein by reference.

RELATED PRIOR ART

PDP Tubes

The following prior art references relate to the use of elongated tubes in a PDP and are incorporated herein by reference.

U.S. Pat. No. 3,602,754 (Pfaender et al.) discloses a multiple discharge gas display panel in which filamentary or capillary size glass tubes are assembled to form a gas discharge panel.

U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel.

U.S. Pat. No. 3,969,718 (Strom) discloses a plasma display system utilizing tubes arranged in a side by side, parallel fashion.

U.S. Pat. No. 3,990,068 (Mayer et al.) discloses a capillary tube plasma display with a plurality of capillary tubes arranged parallel in a close pattern.

U.S. Pat. No. 4,027,188 (Bergman) discloses a tubular plasma display consisting of parallel glass capillary tubes sealed in a plenum and attached to a rigid substrate.

U.S. Pat. No. 5,984,747 (Bhagavatula et al.) discloses rib structures for containing plasma in electronic displays that are formed by drawing glass preforms into fiber-like rib components. The rib components are then assembled to form rib/channel structures suitable for flat panel displays.

U.S. Patent Application Publication 2001/0028216A1 (Tokai et al.) discloses a group of elongated illuminators in a gas discharge device.

U.S. Pat. No. 6,255,777 (Kim et al.) and U.S. Patent Application Publication 2002/0017863 (Kim et al.) disclose a capillary electrode discharge PDP device and a method of fabrication.

The U.S. Patents issued to George et al. and listed above as related microsphere prior art also disclose elongated tubes and are incorporated herein by reference.

The following U.S. Patents by Fujitsu Ltd. of Kawasaki, Japan disclose PDP structures with elongated display tubes and are incorporated herein by reference;

U.S. Pat. Nos. 6,914,382 (Ishimoto et al.), 6,893,677 (Yamada et al.), 6,857,923 (Yamada et al.), 6,841,929 (Ishimoto et al.), 6,836,064 (Yamada et al.), 6,836,063 (Ishimoto et al.), 6,794,812 (Yamada et al.), 6,677,704 (Ishimoto et al.), 6,650,055 (Ishimoto et al.), and 6,633,117 (Shinoda et al.).

The following U.S. Patent Applications by Fujitsu Ltd. of Kawasaki, Japan disclose PDP structures with elongated display tubes and are incorporated herein by reference:

U.S. Patent Application Publication Nos. 2005/0115495 (Yamada et al.), 2004/0152389 (Tokai et al.), 2004/0033319 (Yamada et al.), 2003/0214224 (Awamoto et al.), 2003/0182967 (Tokai et al.), 2003/0122485 (Tokai et al.), and 2003/0025451 (Yamada et al.).

As used herein elongated tube is intended to include capillary, filament, filamentary, illuminator, hollow rods, or other such terms. It includes an elongated enclosed gas filled structure having a length dimension which is greater than its cross-sectional width dimension. The width of the tube is typically the viewing direction of the display. Also as used herein, an elongated plasma-tube has multiple gas discharge pixels of 100 or more, typically 500 to 1000 or more, whereas a Plasma-shell typically has only one gas discharge pixel. In some special embodiments, the Plasma-shell may have more than one pixel, i.e., 2, 3, or 4 pixels up to 10 pixels.

Prior Art Addressing of Two-Electrode Multi-Color Columnar Discharge Structure In a two electrode columnar discharge PDP as disclosed by Wedding ('158), each light emitting pixel is defined by a gas discharge between a bottom or rear electrode x and a top or front opposite electrode y, each cross-over of the two opposing arrays of bottom electrodes x and top electrodes y defining a pixel or cell.

In U.S. Pat. No. 5,828,356, there is disclosed an addressing scheme for an opposite discharge two-electrode multi-color columnar discharge panel structure with an array of bottom electrodes x and an array of top opposite electrodes y, the crossover of each bottom x electrode and each top y electrode defining a pixel. The sustaining voltage is applied to the opposite bottom electrode x and top electrode y with the gas discharge taking place between the electrodes x and y. This patent uses the same electronic architecture as used in the prior art for monochrome columnar discharge PDP.

Prior Art Addressing of Three Electrode Multi-Color Surface Discharge Structure The three-electrode multi-color surface discharge AC plasma panel structure is widely disclosed in the prior art including U.S. Pat. Nos. 5,661,500 (Shinoda et al.), 5,674,553 (Shinoda et al.), 5,745,086 (Weber), and 5,736,815 (Amemiya), all of which are incorporated herein by reference.

A basic electronics architecture for addressing and sustaining a surface discharge AC plasma display is called Address Display Separately (ADS). The ADS architecture is disclosed in a number of Fujitsu patents including U.S. Pat. Nos. 5,541,618 (Shinoda) and 5,724,054 (Shinoda). Also see U.S. Pat. No. 5,446,344 (Kanazawa) and Shinoda et al. ('500) referenced above. ADS has become a basic electronic architecture widely used in the AC plasma display industry.

Fujitsu ADS architecture is commercially used by Fujitsu and is also widely used by competing manufacturers including Matsushita and others. ADS is disclosed in U.S. Pat. No. 5,745,086 (Weber). See FIGS. 2, 3, 11 of Weber ('086). The ADS method of addressing and sustaining a surface discharge display as disclosed in U.S. Pat. Nos. 5,541,618 (Shinoda) and 5,724,054 (Shinoda) sustains the entire panel (all rows) after the addressing of the entire panel. Thus the addressing and sustaining are done separately and are not done simultaneously as in the practice of this invention.

Another architecture used in the prior art is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. Nos. 3,801,861 (Petty et al.) and 3,803,449 (Schmersal). FIGS. 1 and 3 of the Shinoda ('054) ADS patent discloses AWD architecture as prior art.

The prior art AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse.

Samsung specifically labels this as Address While Display (AWD). See *High-Luminance and High-Contrast HDTV PDP with Overlapping Driving Scheme*, J. Ryeom et al., pages 743 to 746, *Proceedings of the Sixth International Display Workshops,* IDW 99, Dec. 1-3, 1999, Sendai, Japan. AWD is also disclosed in U.S. Pat. No. 6,208,081 (Eo et al.).

LG Electronics Inc. has disclosed a variation of AWD with a Multiple Addressing in a Single Sustain (MASS) in U.S. Pat. No. 6,198,476 (Hong et al.). Also see U.S. Pat. No. 5,914,563 (Lee et al.).

The present SAS invention offers a unique electronic architecture which is different from prior art columnar discharge and surface discharge electronics architectures including ADS, AWD, and MASS and offers important advantages as discussed herein.

Addressing of Surface Discharge Structure in Accordance with this Invention

The present SAS invention comprises addressing one display section of a three-electrode Plasma-shell discharge PDP while another section of the PDP is being simultaneously sustained. This architecture is called Simultaneous Address and Sustain (SAS).

In accordance with the practice of this SAS invention, addressing voltage waveforms are applied to a surface discharge AC plasma display having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of this invention is that it allows selectively addressing of one section of a surface discharge panel, for example with selective write and/or selective erase voltages while another section of the panel is being simultaneously sustained. A section is defined as a predetermined number of bulk sustain electrodes x and row scan electrodes y. In a surface discharge display, a single row is comprised of one pair of parallel top electrodes x and y.

In accordance with one embodiment of this SAS invention, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment hereof, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In the practice of this invention, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields.

Addressing is the selective application of data to individual pixels. It includes the writing or erasing of individual pixels.

Reset is a voltage pulse which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with a further embodiment of this SAS invention, there is applied a slow rise time or slow ramp reset voltage. As used herein slow rise time or slow ramp voltage is a bulk address commonly called a reset pulse with a positive or negative slope so as to provide a uniform wall charge at all pixels in the PDP.

The slower the rise time of the reset ramp, the less visible the light or background glow from those off-pixels (not in the on-state) during the slow ramp bulk address.

Less background glow is particularly desirable for increasing the contrast ratio which is inversely proportional to the light-output from the off pixels during the reset pulse. Those off-pixels which are not in the on-state will give a background glow during the reset. The slower the ramp, the less background glow with a resulting higher contrast ratio. Typically the slow ramp reset voltages disclosed in the prior art have a slope of about 3.5 volts per microsecond with a range of about 2 to about 9 volts per microsecond.

In the practice of this invention, it is possible to use slow ramp reset voltages below 2 volts per microsecond, for example about 1 to 1.5 volts per microsecond without decreasing the number of PDP rows, without decreasing the number of sustain pulses or without decreasing the number of subfields.

Slow Ramp Reset Voltage

The prior art discloses slow rise slopes or ramps for the addressing of AC plasma displays. The early patents include U.S. Pat. Nos. 4,063,131 (Miller), 4,087,805 (Miller), 4,130,770 (Miller et al.), 4,087,807 (Miavecz), 4,611,203 (Criscimagna et al.), and 4,683,470 (Criscimagna et al.).

An architecture for a slow ramp reset voltage is disclosed in U.S. Pat. No. 5,745,086 (Weber). Weber ('086) discloses positive or negative ramp voltages that exhibit a slope that is set to assure that current flow through each display pixel site remains in a positive resistance region of the gas discharge characteristics. The slow ramp architecture is disclosed in FIG. 11 of Weber ('086) in combination with the Fujitsu ADS.

PCT Patent Application WO 00/30065, U.S. Pat. Nos. 6,738,033(Hibino et al.), and 6,900,598 (Hibino et al.) also disclose architecture for a slow ramp reset voltage. The Habino et al. references specify a total ramp reset cycle time restricted to less than 360 microseconds for a display panel resolution up to 1080 row scan electrodes with a maximum of 8 subfields using dual scan. With dual scan, Habino et al. can obtain up to 15 subfields for lower resolution displays such as 480 and 768 row scan electrodes.

The present SAS invention allows for a ramp reset cycle time up to 1000 microseconds (one millisecond) or more depending upon the display panel resolution. For a display panel resolution of 1080 row scan electrodes, the SAS invention allows for a ramp reset cycle time up to 800 microseconds without decreasing the number of sustains and/or subfields as required in the prior art.

For lower panel scan row resolutions of 480 and 768, this SAS invention allows a ramp reset cycle time up to 1000 microseconds.

Habino et al. specifies a reset voltage rise slope of no more than 9 volts per microsecond. Because the entire reset cycle time of Habino et al. is a maximum of 360 microseconds, it is not feasible for Habino et al. to use a reset ramp slope of 1.5 volts per microsecond without also decreasing the maximum or peak voltage amplitude of the reset voltage below the amplitude required for reliable discharge and stable addressing. The practice of the present SAS invention allows for the use of a reset ramp slope of 1 to 1.5 volts per microsecond at the maximum reset voltage amplitude required for reliable discharge and stable addressing.

The practice of this present SAS method and invention also allows the use of a low reset voltage rise slope of about 1 to 1.5 volts per microsecond with an overall ramp reset cycle time up to 1000 microseconds.

In one embodiment of this invention there is used a ramp reset cycle time of 800 microseconds, a display resolution of 1080 row scan electrodes, and a reset voltage rise slope of 1 to 1.5 volts per micro-second.

The resolutions typically contemplated in the practice of this invention are 480, 600, 768, 1024, 1080, and 1200 row scan electrodes which are currently used in the PDP industry. However, other resolutions may be used.

Advantages of SAS

SAS allows for simultaneous addressing and sustaining thereby providing more time within the frame for other waveform operations. By comparison the ADS architecture of Fujitsu allocates 75% of the frame time for addressing and 25% for sustaining.

Because both the addressing and sustaining are completed in 75% of the available frame time, SAS has 25% remaining frame time.

SAS can provide 12 to 17 subfields for panel resolutions up to 768 row scan electrodes and 10 to 12 subfields for resolutions of 1080 row scan electrodes without using dual scan.

As noted above slow reset ramp can also be used with SAS. The slow ramp reset can be tailored to ramp slopes of 1.5 microseconds per volt or less which greatly minimizes background glow. This is not possible with the ADS approach of Fujitsu. SAS also provides for a more uniform contrast ratio, better wall charge profile and improved addressing stability.

BRIEF DESCRIPTION OF THE DRAWINGS

FIGS. 14A, 14B, 14C are tables mapping the addressing of the physical locations of the Plasma-shells in a PDP.

DETAILED DESCRIPTION OF THE DRAWINGS

Figure 1:
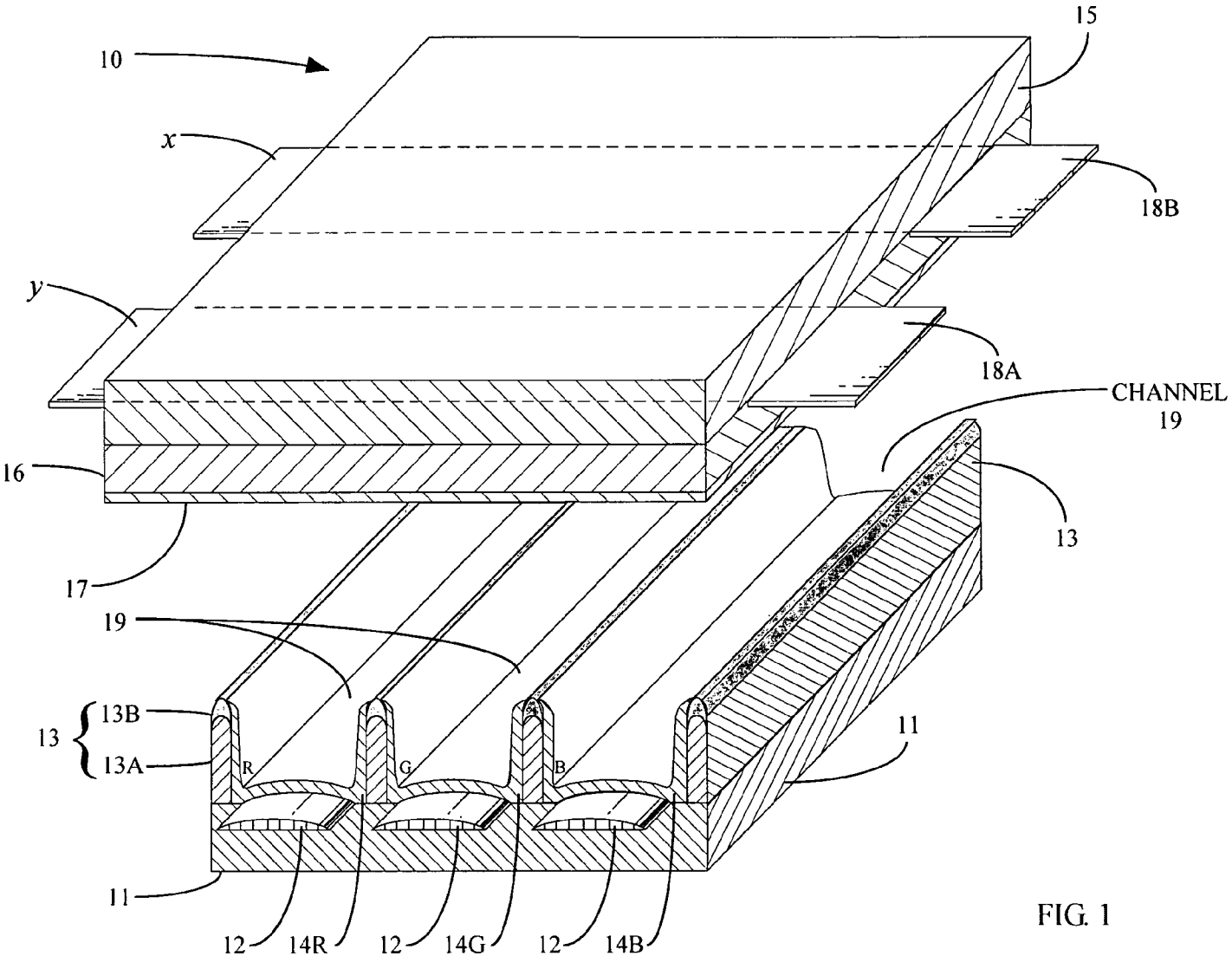
FIG. 1 shows a prospective view of an AC gas discharge plasma display panel (PDP) with a surface discharge structure.
Figure 2:
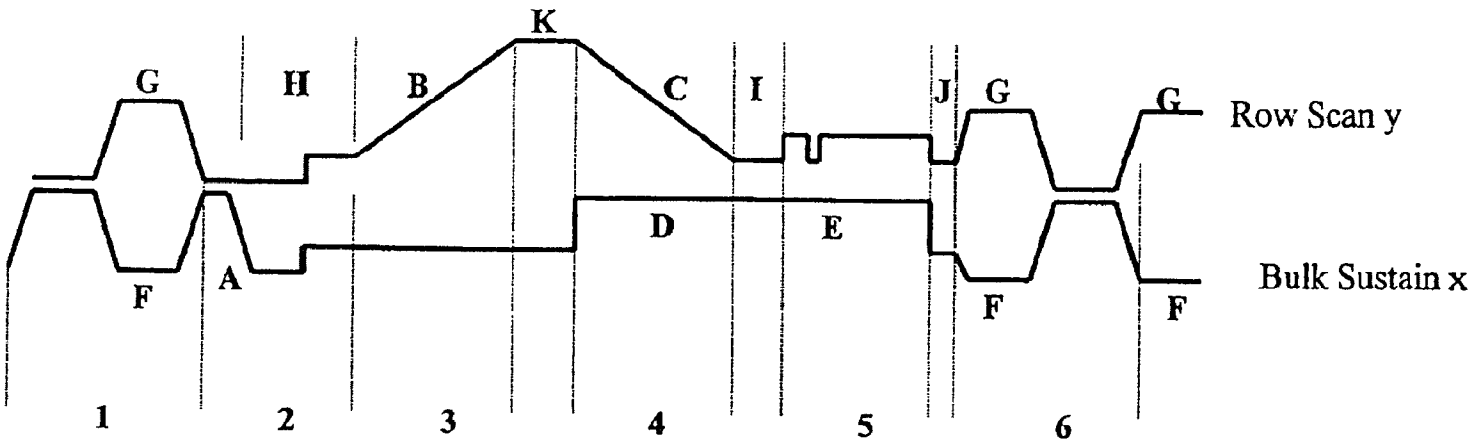
FIG. 2 shows a Simultaneous Address and Sustain (SAS) waveform.

FIG. 1 shows an AC gas discharge plasma display panel with a surface discharge structure 10 similar to the surface discharge structure illustrated and described in FIG. 2 of U.S. Pat. No. 5,661,500 (Shinoda et al.) which is cited above and incorporated herein by reference. The panel structure 10 has a bottom or rear glass substrate 11 with column data electrodes 12, barriers 13, and phosphor 14R, 14G, 14B.

Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan (or sustain) electrodes 18A and x bulk sustain electrodes 18B, dielectric layer 16 covering the electrodes 18A and 18B, and a magnesium oxide layer 17 on the surface of dielectric 16. The magnesium oxide is for secondary electron emission and helps lower the overall operating voltage of the display.

A plurality of channels 19 are formed by the barriers 13 containing the phosphor 14. When the two substrates 11 and 15 are sealed together, an ionizable gas mixture is introduced into the channels 19. This is typically a Penning mixture of the rare gases. Such gases are well known in the manufacture and operation of gas discharge displays.

As noted above, each electrode 12 on the bottom substrate 11 is called a column data electrode. The y electrode 18A on the top substrate 15 is the row scan (or sustain) electrode and the x electrode 18B on the top substrate 15 is the bulk sustain electrode. A pixel or sub-pixel is defined by the three electrodes 12, 18A, and 18B. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel.

Although not illustrated in FIG. 1, the y row scan (or sustain) electrode 18A and the x bulk sustain electrode 18B may each be a transparent material such as tin oxide or indium tin oxide (ITO) with a conductive thin strip, ribbon or bus bar along one edge. The thin strip may be any conductive material including gold, silver, chrome-copper-chrome, or like material. Both pure metals and alloys may be used. This conductive strip is illustrated in FIG. 2 of Shinoda ('500).

Split or divided electrodes connected by cross-overs may also be used for x and y for example as disclosed in U.S. Pat. No. 3,603,836 (Grier). A split electrode structure may also be used for the column data electrodes.

The column data electrodes may be of different widths for each R, G, B phosphor as disclosed in U.S. Pat. No. 6,034,657 (Tokunaga et al.).

The electrode arrays on either substrate are shown in FIG. 1 as orthogonal, but may be of any suitable pattern including zig-zag or serpentine.

Although the practice of this invention is described herein with each pixel or sub-pixel defined by a three-electrode surface discharge structure, it will be understood that this invention may also be used with surface discharge structures having more than three distinct electrodes, for example more than two distinct electrodes on the top substrate and/or more than one distinct electrode on the bottom substrate. In the literature, some surface discharge structures have been described with four or more electrodes including three or more electrodes on the front substrate.

The prior art has also described surface discharge structures where there is a sharing of electrodes between pixels or sub-pixels on the front substrate. Fujitsu has described this structure in a paper by Kanazawa et al. published on pages 154 to 157 of the 1999 *Digest of the Society for Information Display*. Fujitsu calls this "Alternating Lighting on Surfaces" or ALIS. Fujitsu has used ALIS with ADS. Shared electrodes may be used in the practice of the present invention.

FIG. 2 shows a Simultaneous Address and Sustain (SAS) waveform for the practice of this invention with a surface discharge AC plasma display for example a PDP as illustrated in FIG. 1. FIG. 2 shows SAS waveforms with Phases 1, 2, 3, 4, 5, 6 for the top row scan electrode y and the top bulk sustain electrode x. In FIG. 2, the scan row electrode y corresponds to electrode 18A in FIG. 1. The bulk sustain electrode x corresponds to electrode 18B in FIG. 1.

Figure 3:
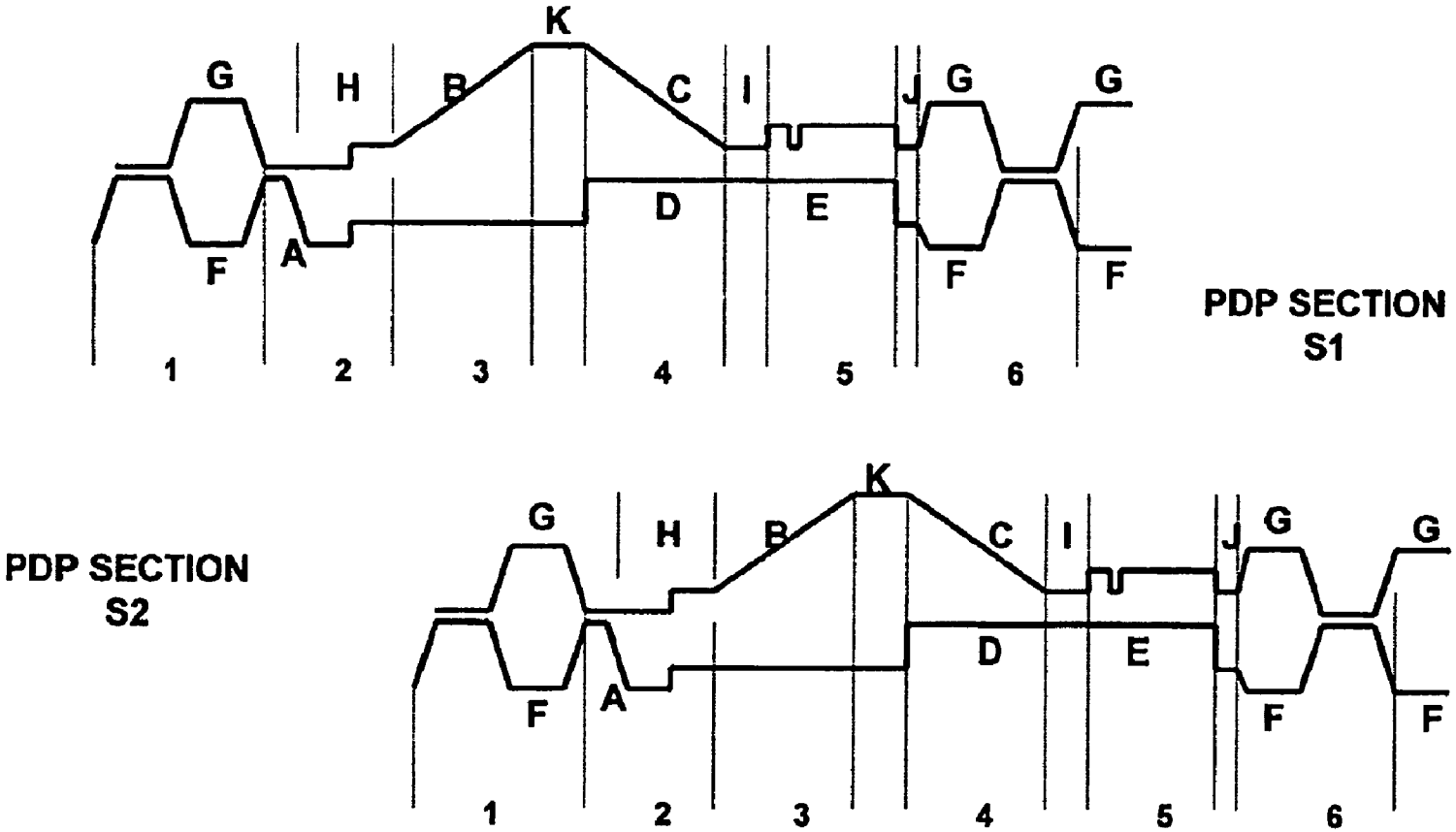
FIG. 3 shows an SAS waveform for simultaneous addressing and sustaining different sections $S_1$ and $S_2$ of a surface discharge PDP.

In Phases 1 and 6 of FIG. 2 the sustaining pulse for the electrodes x and y is shown. The data electrode CD (element 12 in FIG. 1) is simultaneously addressing another section of the display as shown in FIG. 3 which is not being sustained. In the Fujitsu ADS architecture the bottom column data electrode CD is positively offset during sustain and simultaneous operations are not allowed.

Phase 2 of FIG. 2 is the priming phase for the up ramp reset. A reset pulse conditions both the on and off pixels to the same wall charge. It provides a uniform wall charge to all pixels. A is a sustain pulse that is narrower in length than the previous sustain pulses. Its function is to sustain the on pixels and immediately extinguish them. It is sufficiently narrow (typically 1 microsecond or less) to prevent wall charges from accumulating. This narrow pulse causes a weak discharge and may be at higher voltages relative to other sustain pulses in the system. Alternately, a wider pulse with a lower voltage than G may be used.

As illustrated in FIG. 2, G is the highest and most positive amplitude of the sustain. F is the lowest and most negative amplitude of the sustain.

H is a period of time sufficient to allow the ramp to take advantage of the priming caused by the narrow sustain pulse and erase.

At the end of Phase 2 the row scan electrode y and bulk sustain electrode x go back to reference. This can also occur at the end of Phase 4 and the beginning of Phase 5, but such requires additional circuitry and adds to the cost of the system.

Phase 3 of FIG. 2 is the up ramp reset. Because of the SAS architecture, B can be made to ramp slower than prior art architecture (without implementing dual scan). This allows for uniform wall charge deposition. It also reduces background glow and increases the addressing voltage window. K is the idle time before negative ramp reset.

Phase 4 of FIG. 2 is the down ramp reset. If necessary, C and D may be combined to provide a weak discharge. If the up ramp B is slow enough, D may not be needed and C can have an RC slope, where R is the resistance of the electronic circuitry and C is the capacitance of the AC plasma display panel. A weak discharge caused by B or the combination of C and D will further insure a uniform wall charge profile for the various pixel or sub-pixel sites. I is the idle time before addressing.

Phase 5 of FIG. 2 shows the addressing of the row scan electrode y. The row addressing voltage is at an amplitude level sufficiently high to preserve the negative wall charge put on the pixel by the reset pulses of Phases 3 and 4. The row scan electrode y is selectively adjusted so that it may be selectively addressed by the bottom column data electrode CD. J is the idle time before sustaining.

The bulk sustain electrode x has a positive voltage applied throughout the addressing phase to induce charge transport between the pair of electrodes x and y which are sustained after the addressing discharge has taken place.

FIG. 3 shows the SAS waveform of FIG. 2 being used to address and sustain different Sections S1 and S2 of a surface discharge AC plasma display. The waveform for S1 is simultaneously addressing while the waveform for S2 is sustaining. Each waveform for the two Sections S1 and S2, is a repeat of the SAS waveform described in FIG. 2, but each is out of phase with respect to the other as illustrated in FIG. 3.

Figure 4:
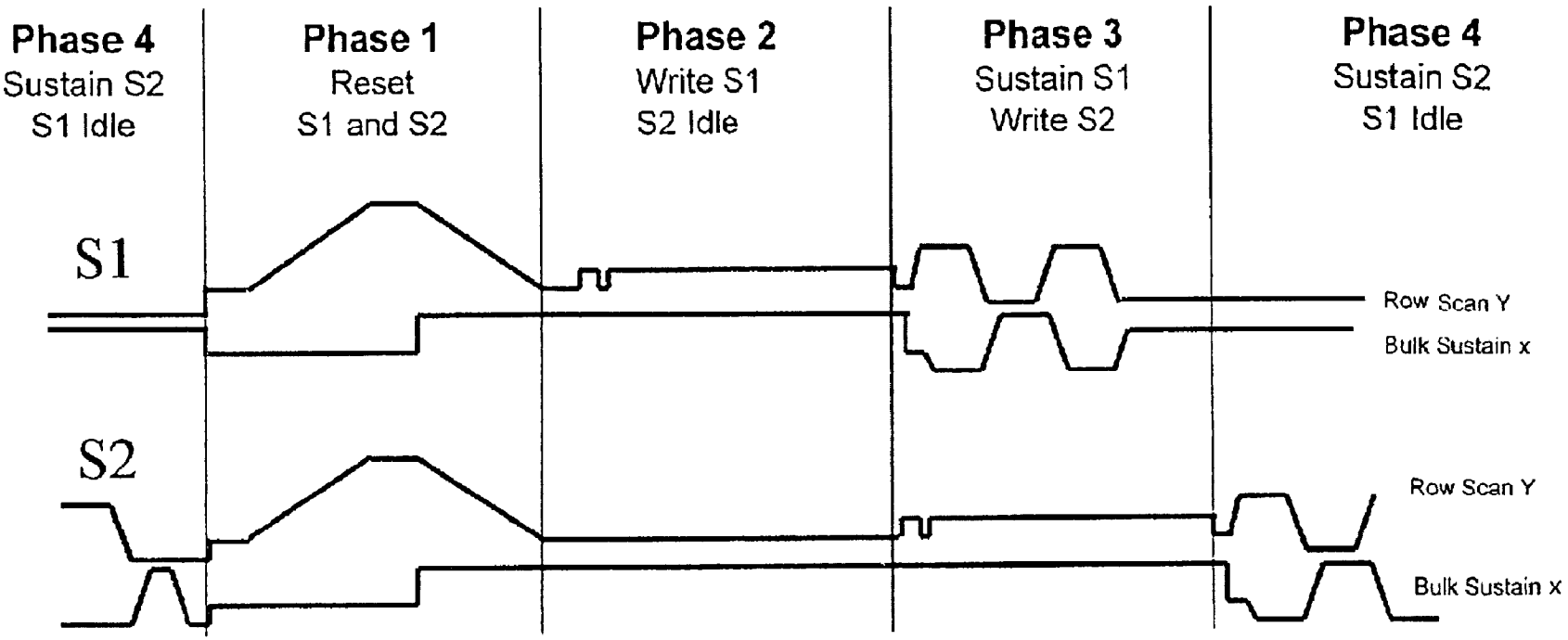
FIG. 4 shows another SAS waveform for simultaneous addressing and sustaining different sections $S_1$ and $S_2$ of a surface discharge PDP.

The waveform of FIG. 4 may also be used for addressing one section $S_1$ while another section $S_2$ is simultaneously being sustained. The sections $S_1$ and $S_2$ may be sustained with the same number of sustains per subfield or with a different number of sustains per subfield.

In Table I there is presented a 10 subfield example using the waveform of FIG. 4 with the same number of sustains in each subfield for Section 1 and Section 2.

TABLE II

| | Subfield | | | | | | | | | |
|---|---|---|---|---|---|---|---|---|---|---|
| | 1 | 2 | 3 | 4 | 5 | 6 | 7 | 8 | 9 | 10 |
| # sustains $S_1$ | 96 | 96 | 96 | 96 | 64 | 32 | 16 | 8 | 4 | 2 |
| # sustains $S_2$ | 96 | 96 | 96 | 96 | 64 | 32 | 16 | 8 | 4 | 2 |

Table II shows one subfield within the frame.

TABLE III

| | Subfield 1 | | | |
|---|---|---|---|---|
| $S_1$ | Reset | Address | 96 Sustain | |
| $S_2$ | Reset | | Address | 96 Sustain |

Table III shows 10 subfields with a different number of sustains in each subfield for $S_1$ and $S_2$.

TABLE IV

| | Subfield | | | | | | | | | |
|---|---|---|---|---|---|---|---|---|---|---|
| | 1 | 2 | 3 | 4 | 5 | 6 | 7 | 8 | 9 | 10 |
| # sustain $S_1$ | 96 | 96 | 96 | 96 | 64 | 32 | 16 | 8 | 4 | 2 |
| # sustain $S_2$ | 2 | 4 | 8 | 16 | 32 | 64 | 96 | 96 | 96 | 96 |

Table IV shows one subfield within the frame.

TABLE V

| | | | Subfield 1 | |
|---|---|---|---|---|
| $S_1$ | Reset | Address | 96 Sustain | |
| $S_2$ | Reset | | Address | 2 Sustain |

In the case of different sustains being employed by $S_1$ and $S_2$, an additional advantage may be derived by changing the order in which $S_1$ and $S_2$ are addressed. Additional time savings may also be obtained if the section with the larger number of sustains is addressed in Phase 2. This allows for a greatest amount of overlap to occur between sustaining and addressing in Phase 3. The result is more time available for ramped resets, additional sustains, additional subfields, and/or more rows.

Figure 5:
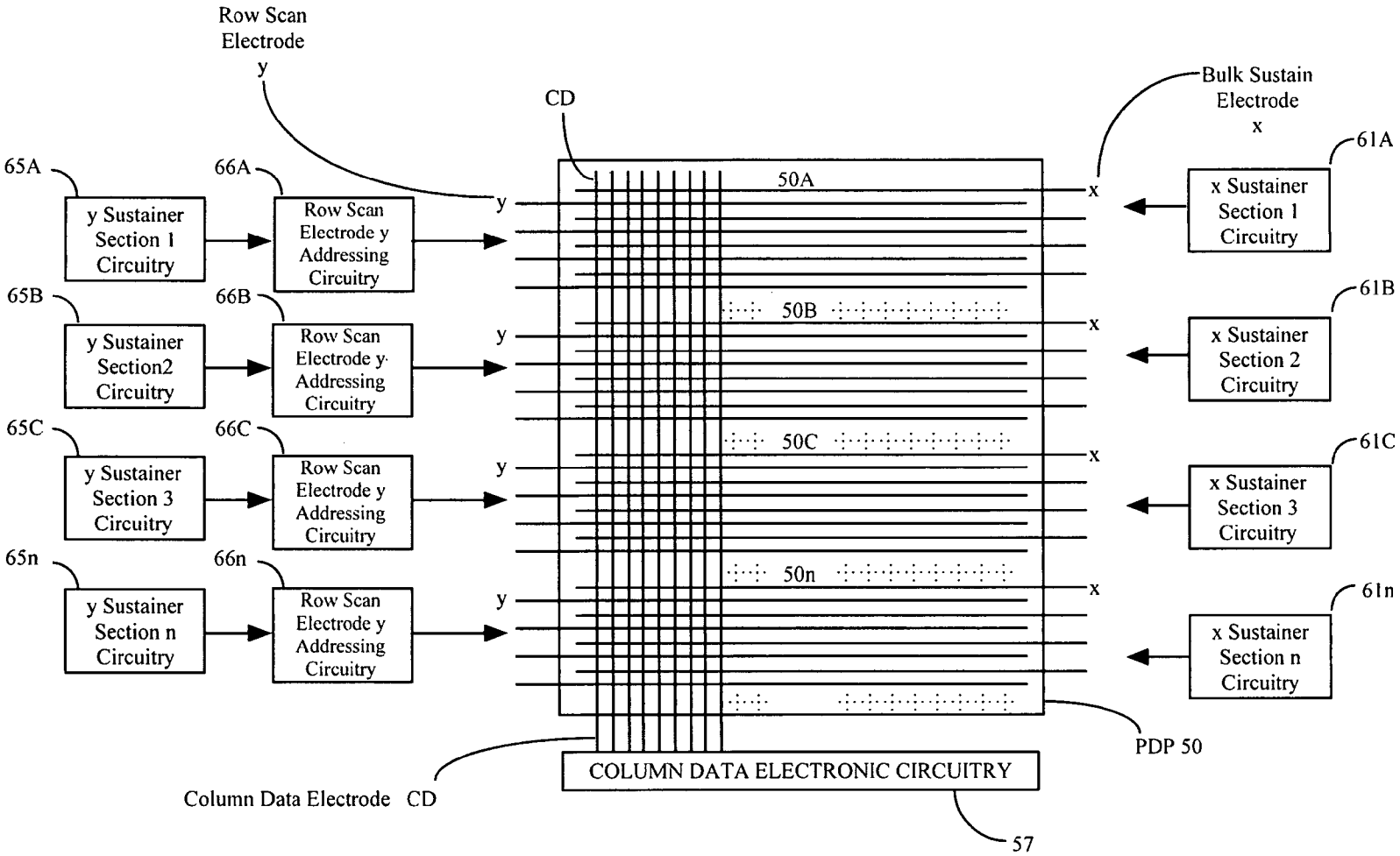
FIG. 5 shows an SAS electronic circuitry diagram for simultaneous address and a sustain of different sections of a surface discharge PDP.

The waveforms of FIGS. 2, 3, and 4 may be implemented with the Block Diagram Circuitry of FIG. 5.

FIG. 5 is an electronics circuitry block diagram for Simultaneous Address and Sustain (SAS) of a surface discharge AC plasma display such as shown in FIG. 1. This shows the practice of this invention on a surface discharge AC plasma display panel (PDP) 50 subdivided into n sections 50A, 50B, 50C, 50*n*. As shown in FIG. 5, each section has at least four pairs of parallel top electrodes y and x where y is the row scan electrode and x is the bulk sustain electrode. Although each section of the PDP in FIG. 5 is shown with four pairs of parallel top electrodes y and x, each section may contain more than four pairs. Also the sections are typically without blank spacing between sections as shown in FIG. 5. The blank spacing is used to illustrate that the sections are separate and distinct. Each PDP section in FIG. 5 also has a number of Column Data Electrodes CD, which are connected to Column Data Electronic Circuitry 57. The CD electrodes are the same as the electrodes 12 in FIG. 1. The electrodes x and y are the same as electrodes 18B and 18A, respectively, in FIG. 1.

FIG. 5 shows an embodiment in which y Addressing Circuitry and y Sustainer Circuitry for the Row Scan electrodes y is separately provided for each of the Sections 50A, 50B, 50C, and 50*n*. Addressing Circuitry 66A and y Sustain Section I Circuitry 65A are connected to the Scan Electrodes y of Section 50A. The x Sustainer Section I Circuitry 61A is connected to the Sustain Electrode x of Section 50A. This address and sustain circuitry is repeated for y and x for Sections 50 B, 50C and 50*n*. The y Addressing Circuitry and y Sustain Circuitry of each section works with the x Sustain Circuitry of each section to address and sustain each unique section of the PDP 50. In FIG. 5 this uniquely addressable portion is labeled Section 50A, 50B, 50C, 50*n*, each being comprised of one or more y scan electrode-x sustain electrode pairs. FIG. 5 shows an embodiment in which pairs of y scan electrode-x sustain electrodes of a given section are adjacent to each other on the PDP. This method will also work if scan electrode-sustain electrode pairs of a given section are not adjacent to each other, but are interlaced throughout the display.

Artifact Reduction

The PDP industry has used various techniques to reduce motion and visual artifacts in a PDP display.

Pioneer of Tokyo, Japan has disclosed a technique called CLEAR for the reduction of false contour and related problems. See "Development of New Driving Method for AC-*PDPs*" by Tokunaga et al. of *Pioneer Proceedings of the Sixth International Display Workshops*, IDW 99, pages 787-790, Dec. 1-3,1999, Sendai, Japan. Also see European Patent Applications EP 1 020 838 A1 by Tokunaga et al. of Pioneer. The CLEAR technique uses an algorithm and waveform to provide ordered dither gray scale in small increments with few motion or visual artifacts. CLEAR comprises turning on pixels followed by selective erase.

In the practice of this invention, it is contemplated that SAS may be combined with CLEAR or a like artifact reduction technique similar to CLEAR as required for the reduction of motion and visual artifacts. Fujitsu discloses an artifact reduction technique similar to CLEAR in combination with ADS in U.S. Pat. No. 6,097,358 (Hirakawa et al.). The CLEAR and other artifact reduction techniques disclosed in the prior art including the above Pioneer IDW publication, EP 1020838 A1, and U.S. Pat. No. 6,097,358 are incorporated herein by reference.

This invention as illustrated herein allows for a larger number of sustain cycles per frame. This allows for a brighter display or alternatively more subfields per display. This also improves the PDP operating margin (window) due to more time allowed for the various overhead functions.

Figure 6A:
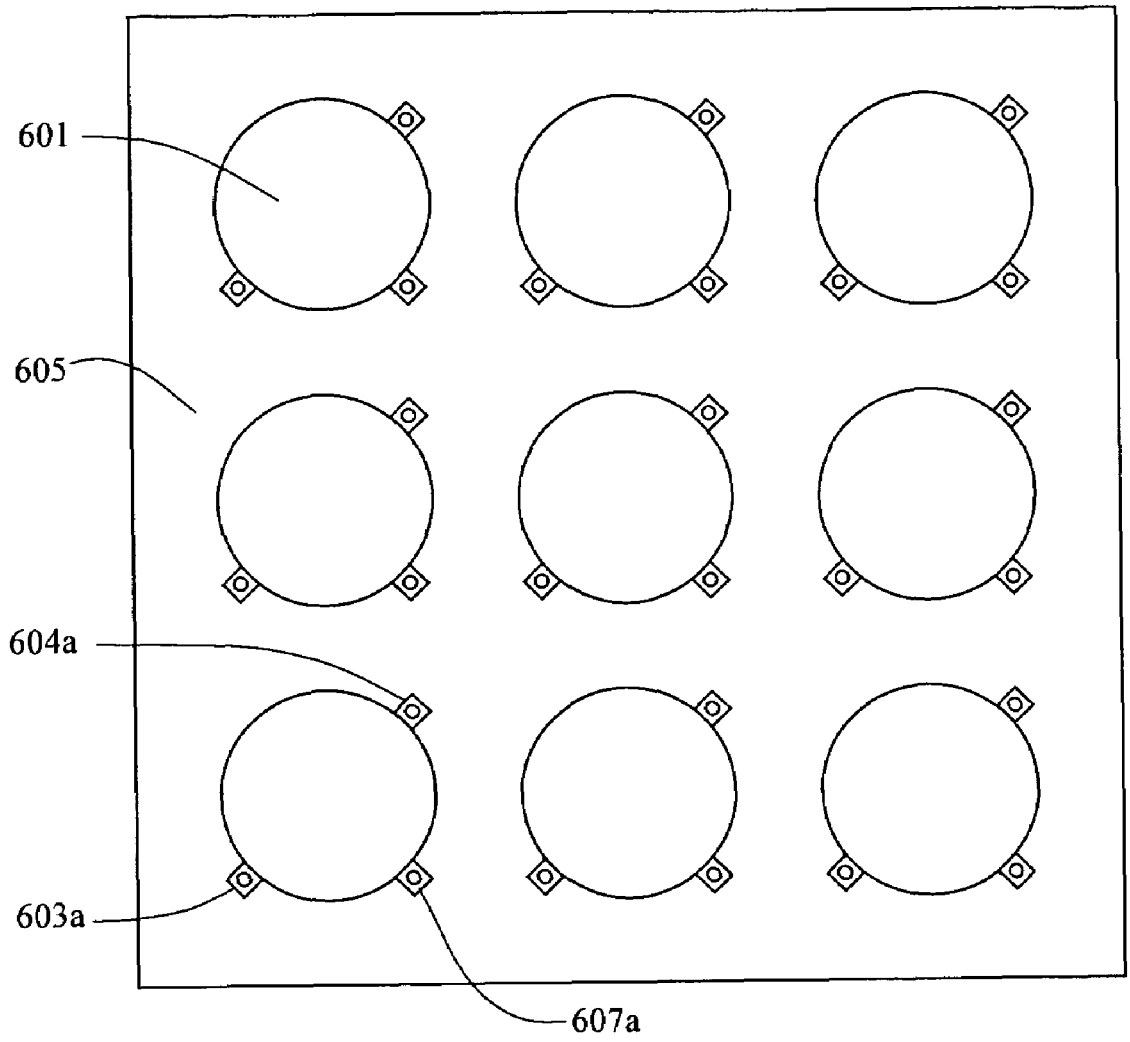
FIGS. 6A, 6B, and 6C are views of a three-electrode single substrate plasma display with gas encapsulating Plasma-spheres.
Figure 6B:
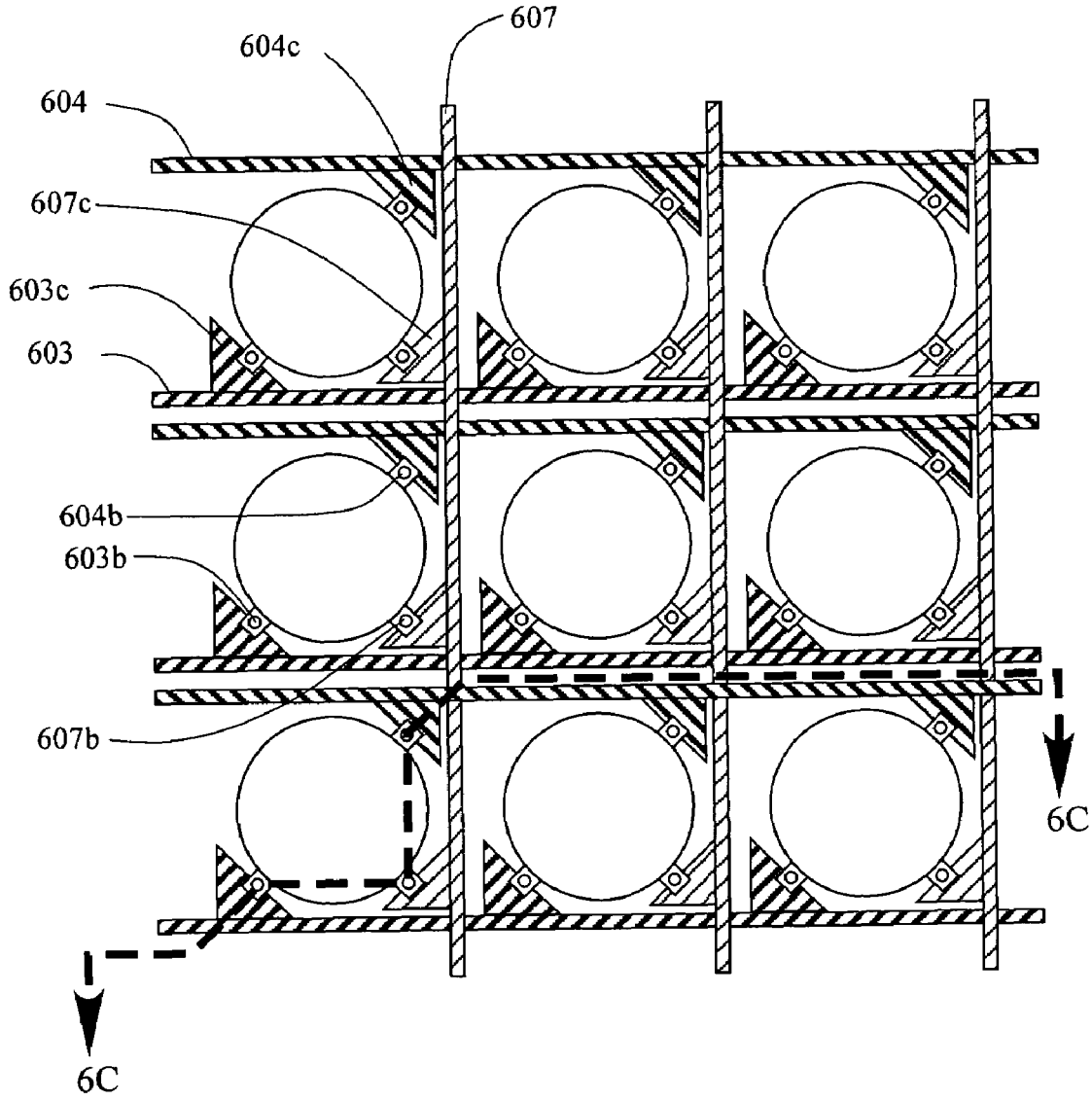
Figure 6C:
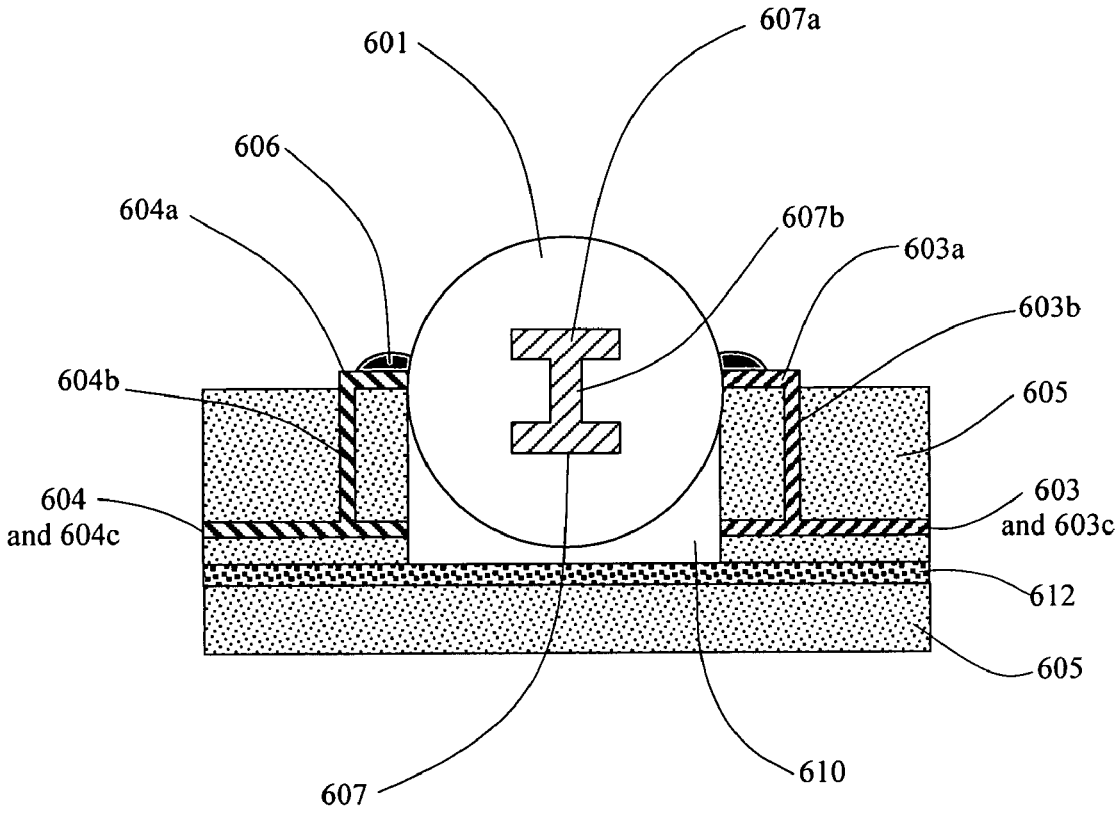

FIGS. 6A, 6B, and 6C show one embodiment using a three-electrode structure with a Plasma-sphere. In this configuration, FIG. 6A shows the Plasma-sphere 601 connected to surface electrode pads 604*a*, 603*a*, and 607*a*. FIG. 6B is a top view of FIG. 6A with a grid of electrodes formed by row electrodes 604 on one layer, row electrodes 603 parallel to 604, but on a different layer (as shown in FIG. 6C) and column electrodes 607. Bridge conductor 604*c* is an extension of row electrode 604 to via 604*b*. Bridge conductor 603*c* is an extension of row electrode 603 to via 603*b*. Bridge conductor 607*c* is an extension of column electrode 607 to via 607*b*.

The Section B-B view in FIG. 6C shows the electrodes 604, 603 and 607 each in a separate plane with a single Plasma-sphere 601 placed within a locating notch 610. This embodiment also shows optional non-conductive adhesive 612 sandwiched between substrate 605 layers. Surface electrode pads 604*a*, 603*a* and 607*a* are bonded to the Plasma-sphere 601 with conductive bonding substance 606. Surface electrode pads 604*a*, 603*a*, and 607*a* connect by micro via 604*b*, 603*b*, and 607*b* to their respective electrodes 604, 603, and 607. This electrode configuration allows for three electrode addressing in which two row electrodes 604 and 603 perform the sustain and row select functions. The column electrode 607 applies data. As shown row electrode 604 is located on a different plane in the substrate 605 than row electrode 603 and is directly underneath. In other embodiments, row electrodes 604 and 603 may be in the same plane.

Multiple electrode layers and connecting vias as shown in FIGS. 6A, 6B, and 6C are more easily added to a flexible substrate than to a standard rigid substrate made from glass or ceramic. Multiple layers of electrodes allow for novel addressing schemes not readily achieved with a glass substrate plasma display.

Figure 7A:
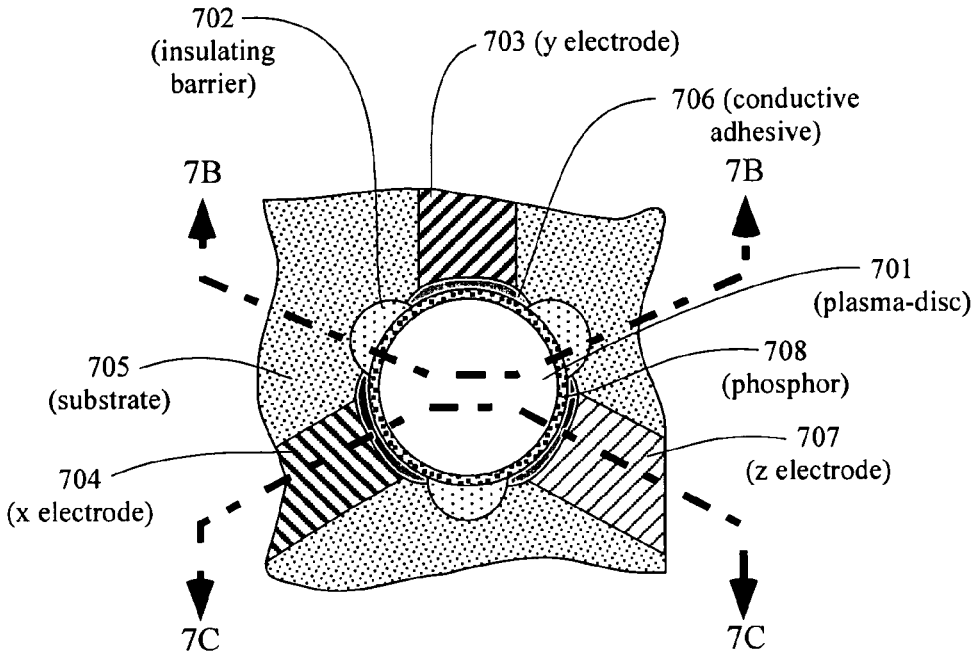
FIG. 7A is a top view of a Plasma-disc mounted on a substrate with three electrodes and electrode insulating barriers.
Figure 7B:
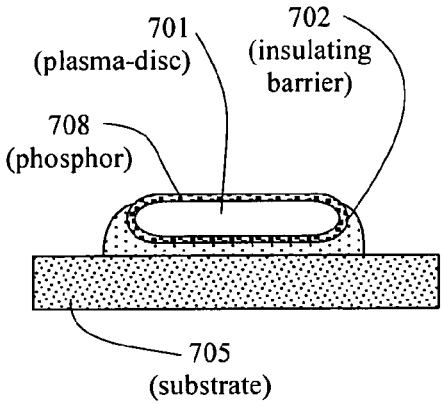
FIG. 7B is an orthogonal Section 7B-7B View of FIG. 7A.
Figure 7C:
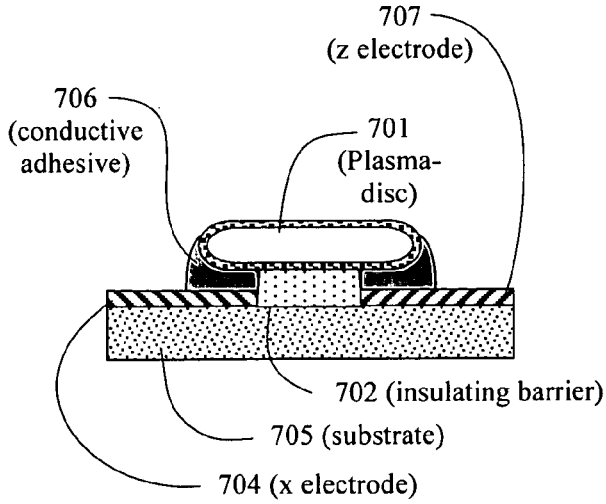
FIG. 7C is an orthogonal Section 7C-7C View of FIG. 7A.

FIG. 7A is a top view of a single Plasma-disc pixel element 701 bonded to substrate 705 with insulating barrier adhesive 702. The Plasma-disc 701 is also bonded to both x electrode 704, y electrode 703 and z electrode 707, by conductive bonding substance 706. The insulating barrier 702 is deposited in a Y shape and functions to both bond Plasma-disc 701 to substrate 705 and form an electrical and physical separation barrier between electrodes 703, 704 and 707 and conforming conductive electrode adhesive 706. The conductive bonding substance 706 conforms to the surface of Plasma-disc 701 so as to provide electrical connections to Plasma-disc 701. Phosphor 708 is applied to the surface of Plasma-disc 701 preferentially on the exterior surface to protect it from degradation from the ionizing gas discharge inside the disc. Phosphor 708 may be applied to the entire surface of the disc or only a portion thereof. FIG. 7B illustrates insulating barrier 702 bonding Plasma-disc 701 to substrate 705. FIG. 7C illustrates insulating barrier 702 functioning to isolate electrodes 707 and 704 as well as their respective conductive bonding substance 706.

Figure 8A:
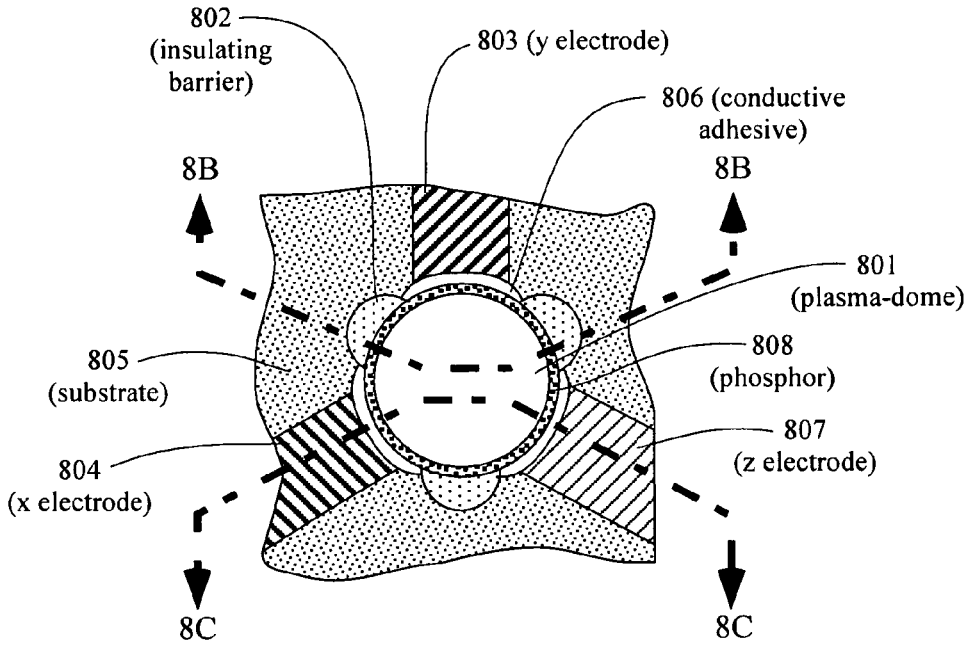
FIG. 8A is a top view of a Plasma-dome mounted with flat side down on a substrate with three electrodes and electrode insulating barriers.
Figure 8B:
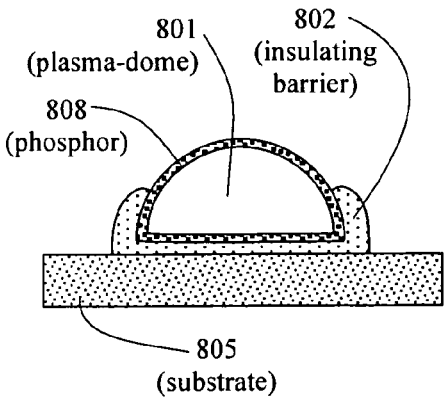
FIG. 8B is a Section 8B-8B View of FIG. 8A.
Figure 8C:
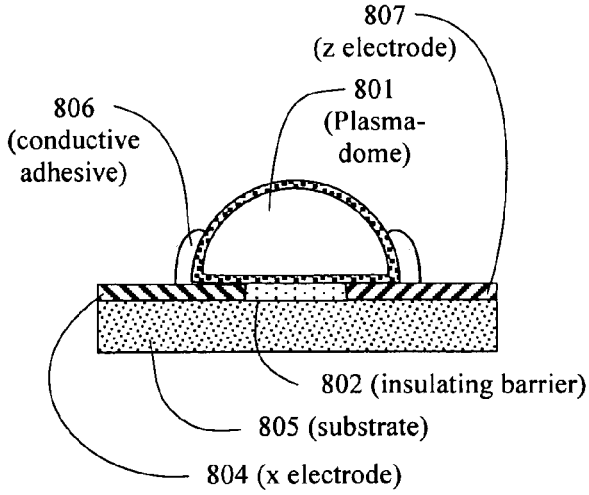
FIG. 8C is a Section 8C-8C View of FIG. 8A.

FIG. 8A is a top view of a single Plasma-dome (flat side down) pixel element 801 bonded to substrate 805 with barrier bonding adhesive substance 802. In addition, the Plasma-dome 801 is also bonded to both x electrode 804, y electrode 803 and z electrode 807 by conductive bonding substance 806. Barrier adhesive 802 is deposited in a Y shape and functions to both bond Plasma-dome 801 to substrate 805 and form an electrical and physical separation barrier between electrodes 803, 804 and 807 and conductive substance 806. The conductive bonding substance 806 conforms to the external surface of the Plasma-dome 801 and functions to provide electrical connection of the electrodes to Plasma-dome 801. Phosphor 808 is applied to the surface of Plasma-dome 801 preferentially on the exterior surface to protect it from degradation from the ionizing gas discharge inside the dome. Phosphor 808 may be applied to the entire surface of the dome or only a portion thereof. FIG. 8B illustrates barrier material 802 bonding Plasma-dome 801 to substrate 805. FIG. 8C illustrates insulating barrier material 802 functioning to isolate electrodes 807 and 804 as well as their respective conductive adhesive 806.

Figure 9:
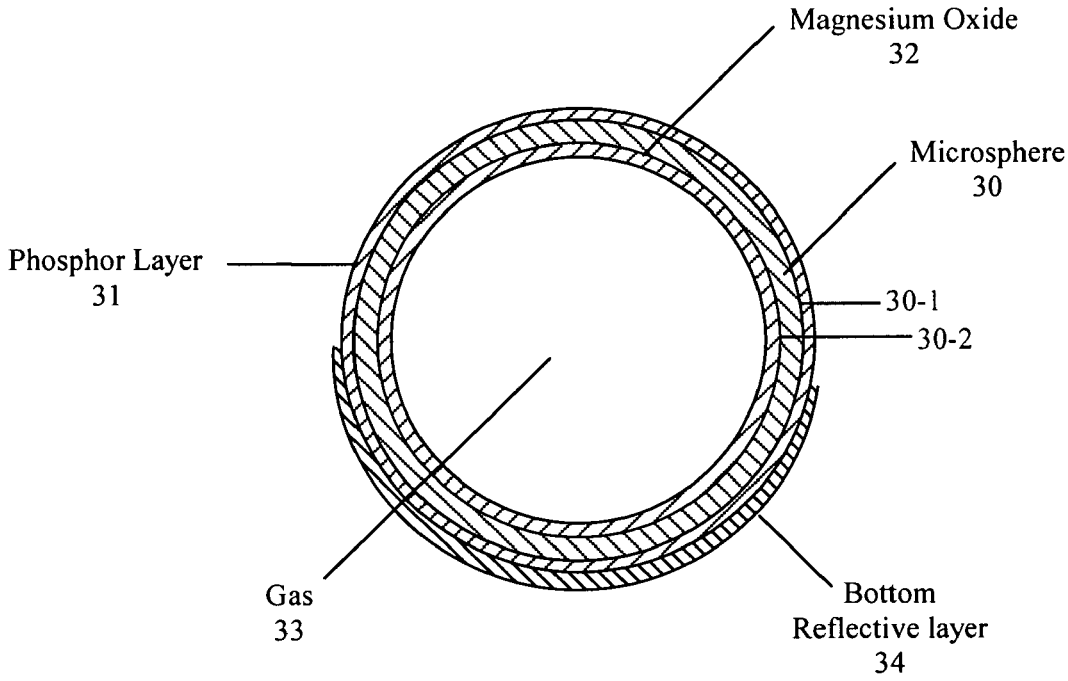
FIG. 9 shows a cross-section view of a Plasma-sphere embodiment.

FIG. 9 shows a cross-sectional view of a best embodiment and mode of the microsphere 30 with external surface 30-1 and internal surface 30-2, an external phosphor layer 31, internal magnesium oxide layer 32, ionizable gas 33, and an external bottom reflective layer 34.

The bottom reflective layer 34 is optional and, when used, will typically cover about half of the phosphor layer 31 on the external surface 30A. This bottom reflective layer 34 will reflect light upward that would otherwise escape and increase the brightness of the display.

Magnesium oxide increases the ionization level through secondary electron emission that in turn leads to reduced gas discharge voltages. The magnesium oxide layer 32 on the inner surface 30-1 of the microsphere 30 is separate from the phosphor which is located on external surface 30-2 of the microsphere 30. The thickness of the magnesium oxide is about 250 Angstrom Units to 10,000 Angstrom Units (Å).

Magnesium oxide is susceptible to contamination. To avoid contamination, gas discharge (plasma) displays are assembled in clean rooms that are expensive to construct and maintain. In traditional plasma panel production, magnesium oxide is typically applied to an entire substrate surface and is vulnerable to contamination. In FIG. 9 the magnesium oxide layer 32 is on the inside surface 30-1 of the microsphere 30 and exposure of the magnesium oxide to contamination is minimized.

The magnesium oxide layer 32 may be applied to the inside of the microsphere 30-1 by using a process similar to the technique disclosed by U.S. Pat. No. 4,303,732 (Torobin). In this process, magnesium vapor is incorporated as part of the ionizable gases introduced into the microsphere while the microsphere is at an elevated temperature.

Plasma-Dome

Figure 10A:
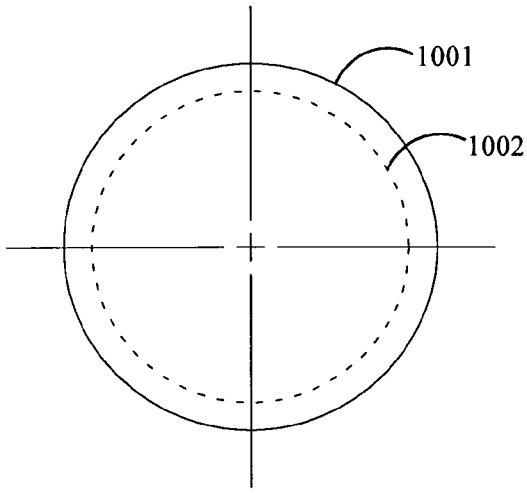
FIGS. 10A, 10B, 10C show a Plasma-dome flattened on one side.
Figure 10B:
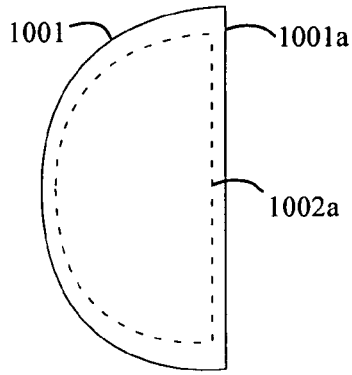
Figure 10C:
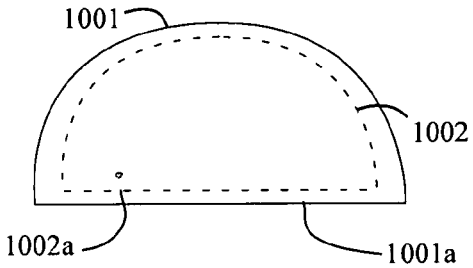

FIG. 10A is a top view of a Plasma-dome showing an outer shell wall 1001 and an inner shell wall 1002. FIG. 10B is a right side view of FIG. 10A showing a flattened outer wall 1001*a* and flattened inner wall 1002*a*. FIG. 10C is a bottom view of FIG. 10A.

Figure 11A:
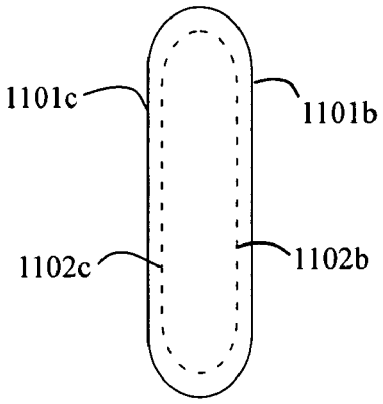
FIGS. 11A, 11B, 11C show a Plasma-dome flattened on three sides.
Figure 11B:
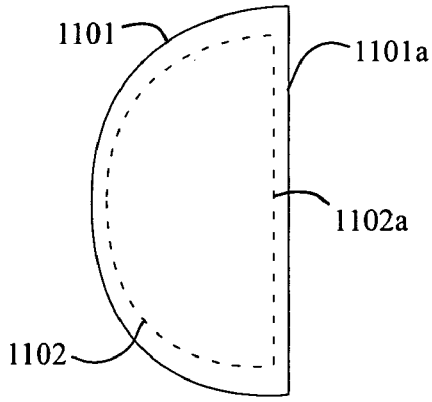
Figure 11C:
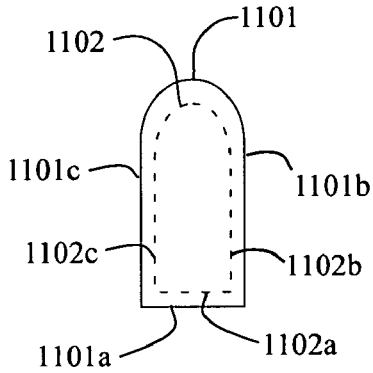

FIG. 11A is a top view of Plasma-dome with flattened inner shell walls 1102*b* and 1102*c* and flattened outer shell walls 1101*b* and 1101*c*. FIG. 11B is a right side view of FIG. 11A showing flattened outer wall 1101 and inner wall 1102. FIG. 11C is a bottom view of FIG. 11A. A flat viewing surface may increase the overall luminous efficiency of the display.

Plasma-Disc

By flattening a Plasma-sphere on one or both sides some advantage is gained in mounting the sphere to the substrate and connecting the sphere to electrical contacts. A Plasma-sphere with a substantially flattened top and/or bottom is called a Plasma-disc. This flattening of the Plasma-sphere is typically done while the sphere shell is at an elevated softening temperature below the melting temperature. The flat viewing surface in a Plasma-disc increases the overall luminous efficiency of a PDP.

Figure 12A:
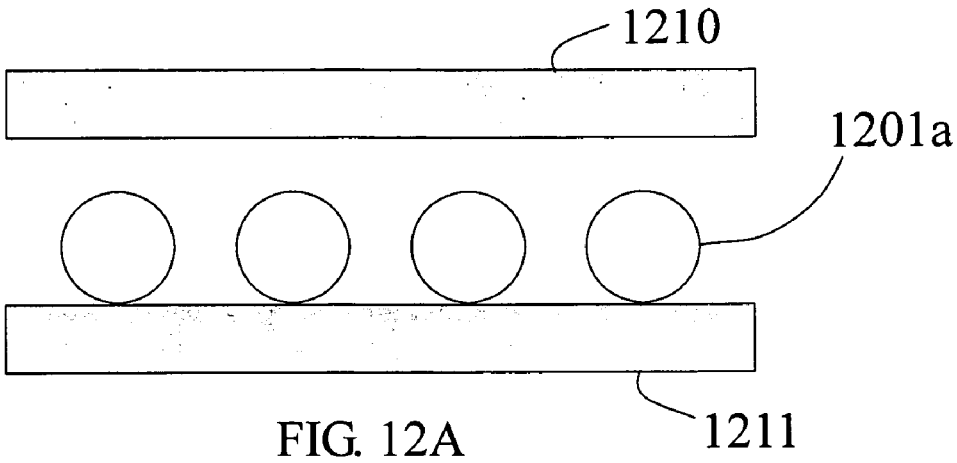
FIGS. 12A, 12B, 12C show method steps for making a Plasma-disc.
Figure 12B:
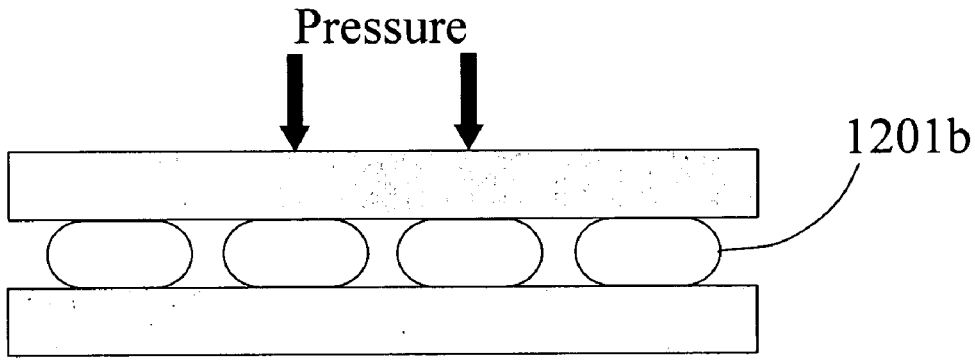
Figure 12C:
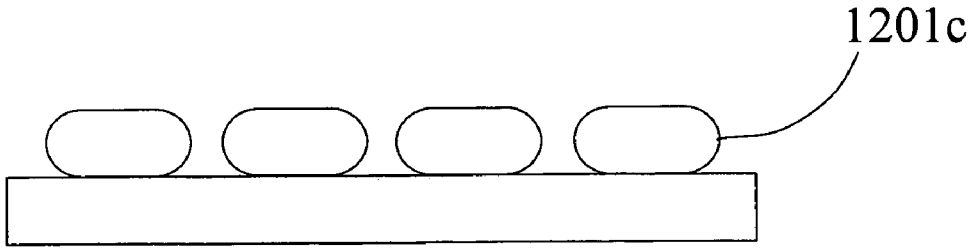

FIGS. 12A, 12B, and 12C show the production of a Plasma-disc from a Plasma-sphere. While the Plasma-sphere 1201*a* is at an elevated temperature, a sufficient pressure or force is applied with member 1210 to flatten the sphere between members 1210 and 1211 into disc shapes with flat top and bottom as illustrated in FIGS. 12A, 12B, and 12C. FIG. 12A shows a Plasma-sphere 1201*a*. FIG 12B shows uniform pressure applied to the Plasma-sphere 1201*a* to form a flatten Plasma-disc 1201*b*. Heat can be applied during the flattening process such as by heating members 1210 and 1211. FIG. 12C shows the resultant flat Plasma-disc 1201*c*. One or more luminescent substances can be applied to the Plasma-disc. Like a coin that can only land "heads" or "tails," a Plasma-disc with a flat top and flat bottom may be applied to a substrate in one of two positions.

Figure 13:
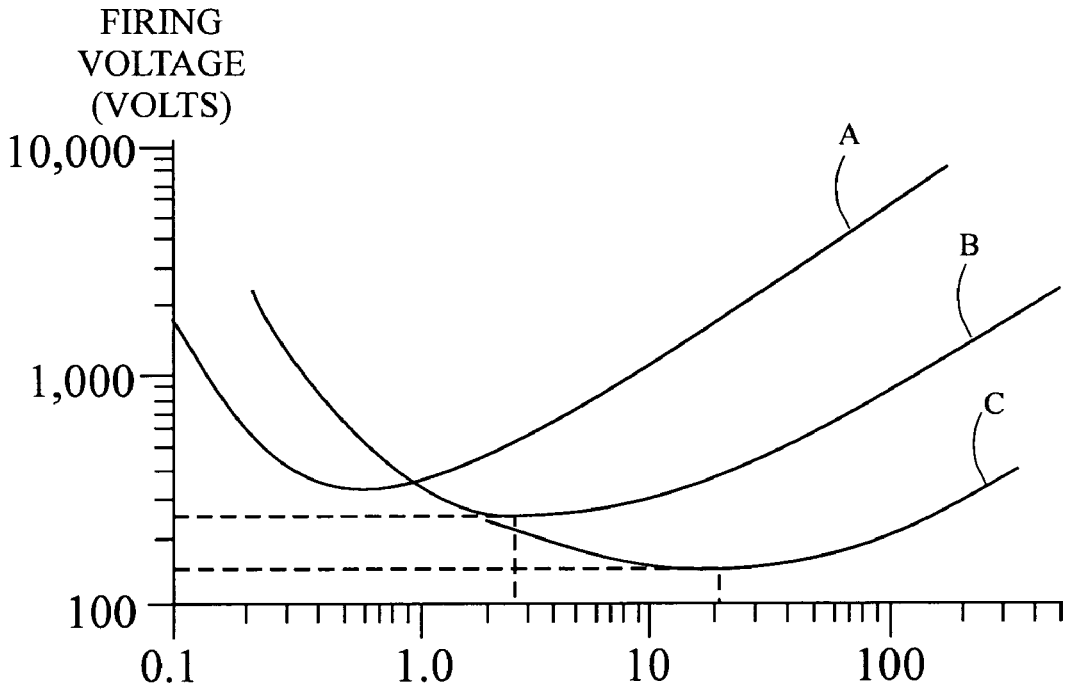
FIG. 13 shows an illustrative Paschen curve for ionizable gas mixture.

The Plasma-shell, i.e., Plasma-sphere, Plasma-disc, or Plasma-dome is filled with an ionizable gas. Each gas composition or mixture has a unique curve associated with it, called the Paschen curve as illustrated in FIG. 13. The Paschen curve is a graph of the breakdown voltage versus the product of the pressure times the discharge distance. It is usually given in Torr-centimeters. As can be seen from the illustration in FIG. 13, the gases typically have a saddle region in which the voltage is at a minimum. Often it is desirable to choose pressure and distance in the saddle region to minimize the voltage. In the case of a Plasma-sphere, the distance is the diameter of the sphere or some cord of the sphere as defined by the positioning of the electrodes. The gas pressure at ambient room temperature inside the Plasma-sphere is selected in accordance with this diameter or cord distance. Knowing the desired pressure $P_1$ at ambient temperature $T_1$, one can calculate the pressure at the heating temperatures using the ideal gas law where $$P_1/T_1=P_2/T_2$$

such that $$P_1=P_2T_1/T_2$$

$P_2$ is the desired pressure of the gas inside a sealed microsphere at ambient temperature $T_2$, $T_1$ is the sealing and gas filing temperature, and $P_1$ is the gas pressure at $T_1$. For example, if a microsphere is filled with gas at 1600° C., the desired gas is maintained at a pressure of about 6 times greater then the desired pressure. For a mixture of 99.99% atoms neon and 0.01% atoms argon with a Paschen minimum of about 10 Torr cm, and a sphere with a diameter of about 0.1 cm with electrodes positioned across the diameter, the desired pressure is about 100 Torr. Thus during the firing and gas filling of the spheres, the gas filling pressure of the neon-argon gas is about 600 Torr.

Dual Scan

In the practice of this invention the PDP may be physically divided into at least two sections with each section being addressed by separate electronics. This was first disclosed in U.S. Pat. Nos. 4,233,623 (Pavliscak) and 4,320,418 (Pavliscak). It is also disclosed in U.S. Pat. No. 5,914,563 (Lee et al.).

In the PDP industry this dividing of the PDP into two sections with separate electronics for each section is called dual scan. It is more costly to use dual scan because of the added electronics and reduced PDP yield. However, dual scan has been necessary with ADS and AWD architecture in order to obtain sufficient subfields at higher resolutions. The practice of this SAS invention allows for a larger number of subfields at higher resolutions without using dual scan.

SAS maintains higher probability of priming particles due to its virtual "dual-scan" like operation. Coupled with improved priming and uniform wall charge distribution, SAS allows for the addressing of high resolution AC plasma displays with 10 to 12 subfields at a high resolution of 1080 row scan electrodes without dual scan.

A standard plasma display is addressed one row at a time. The addressing of each row takes a finite amount of time. In order to maintain a flicker free image, the display must be updated at video rates. There is a practical limit as to how many rows a plasma display may have. In order to achieve more rows with a plasma display, often the column electrodes are split at the center of the display and the two sections are addressed from the top and from the bottom as two independent displays. This is referred to in the PDP industry as dual scan. The splitting of the PDP into two sections is disclosed in Pavliscak (623), Pavliscak (418), and Lee (563), all incorporated herein by reference.

Dual scan can be achieved with a Plasma-shell display by using multiple layers of column electrodes to simultaneously address multiple (2 or more) row electrodes. FIG. 14A is a table that maps physical address of the display to the internal electrode configuration where the number of column (data) electrodes has been doubled. One set of column electrodes is represented as I1 through I9, and a second set of column electrodes parallel to I1 through I9, but on a different plane is represented as m1 through m9. Each set of these column electrodes connects to a unique subset of Plasma-shells, the physical location defined by rows R and columns C. For example the table in FIG. 14A shows I1 through I9 connecting to rows R1 through R4 at columns C1 through C9 and m1 through m9 connecting to rows R5 though R8 at columns C1 though C9. This allows two rows to be addressed simultaneously. In one row scan time, two rows are addressed simultaneously. Although the concept is illustrated with two rows addressed simultaneously, this may be expanded to more than two rows. By addressing two or more rows at a time, the display may be refreshed faster.

In a standard plasma display gray levels are achieved by time multiplexing. The brightness of a pixel is proportional to how many sustain pulses it experiences while in the on state. One frame is composed of subfields with varying numbers of sustains. The subfields may be summed in various combinations to achieve the full compliment of unique gray levels (usually 256). Two problems that occur with this technique are false contour and motion artifact. In general both of these artifacts occur because the human eye does not integrate the subfields properly. There are several ways to alleviate this problem including increasing the update speed as described above. Another way is to separate the pixels that are changing to allow the eye to integrate over an area. By physically separating the pixels that are being addressed, changes will be less obvious to the observer. This may be done with a Plasma-shell display by taking advantage of the ability to have electrodes on multiple layers.

FIG. 14B and FIG. 14C show tables that map the physical address of the display with the electrode address. In FIG. 14B the address electrodes attach in a zig-zag pattern. For example, row scan electrode n4 alternates between rows R4 and R2. When n4 is selected to be scanned, Plasma-shells at (R4,C1), (R2,C2), and (R4, C4) are addressed. The pixels are physically separated in a zig-zag pattern. FIG. 14C shows an alternative pattern in which the pixels are diagonally addressed.

In one embodiment of this invention as illustrated in FIGS. 14A, 14B, 14C, one portion or section of the Plasma-shell display is addressed while another Plasma-shell portion or section is sustained. This is referred to as Simultaneous Address and Sustain (SAS).

In accordance with the electrode connections of FIGS. 14A, 14B, and 14C, multi-layers of cells or pixels may be used to randomize the presentation of cells that are addressed simultaneously. Present PDPs allow only a single layer of metallization so each addressing event addresses a line of adjacent contiguous cells somewhere on the PDP. Multi-layers allow the cross-strap of the individual panel cells or pixels so that cells addressed during the addressing event may not be in a single line, but may be addressed on different lines at the same time. Consequently one may address different PDP sections at the same time and also address in such a way that no two adjacent cells are addressed at the same time anywhere on the panel. This randomizes any concentration of light flashes on the display and mitigates visual defects such as artifacts.

Plasma Shell Materials

The Plasma-shell may be constructed of any suitable material such as glass or plastic as disclosed in the prior art. In the practice of this invention, it is contemplated that the Plasma-shell may be made of any suitable inorganic compounds of metals and/or metalloids, including mixtures or combinations thereof. Contemplated inorganic compounds include the oxides, carbides, nitrides, nitrates, silicates, aluminates, phosphates, and/or borates.

The metals and/or metalloids are selected from magnesium, calcium, strontium, barium, yttrium, lanthanum, cerium, neodymium, gadolinium, terbium, erbium, thorium, titanium, zirconium, hafnium, vanadium, niobium, tantalum, chromium, molybdenum, tungsten, manganese, rhenium, iron, ruthenium, osmium, cobalt, rhodium, iridium, nickel, copper, silver, zinc, cadmium, boron, aluminum, gallium, indium, thallium, carbon, silicon, germanium, tin, lead, phosphorus, and bismuth.

Inorganic materials suitable for use are magnesium oxide(s), aluminum oxide(s), zirconium oxide(s), and silicon carbide(s) such as MgO, $Al_2O_3$, $ZrO_2$, $SiO_2$, and/or SiC.

In one embodiment of this invention, the Plasma-shell is made of fused particles of glass, ceramic, glass ceramic, refractory, fused silica, quartz, or like amorphous and/or crystalline materials including mixtures of such.

In one preferred embodiment, a ceramic material is selected based on its transmissivity to light after firing. This may include selecting ceramics material with various optical cutoff frequencies to produce various colors. One preferred material contemplated for this application is aluminum oxide. Aluminum oxide is transmissive from the UV range to the IR range. Because it is transmissive in the UV range, phosphors excited by UV may be applied to the exterior of the Plasma-shell to produce various colors. The application of the phosphor to the exterior of the Plasma-shell may be done by any suitable means before or after the Plasma-shell is positioned in the PDP, i.e., on a flexible or rigid substrate. There may be applied several layers or coatings of phosphors, each of a different composition.

In one specific embodiment of this invention, the Plasma-shell is made of an aluminate silicate or contains a layer of aluminate silicate. When the ionizable gas mixture contains helium, the aluminate silicate is especially beneficial in preventing the escaping of helium.

It is also contemplated that the Plasma-shell may be made of lead silicates, lead phosphates, lead oxides, borosilicates, alkali silicates, aluminum oxides, and pure vitreous silica.

For secondary electron emission, the Plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, aluminates, phosphates, borates, and other inorganic compounds of the above and other elements.

The Plasma-shell may also contain or be partially or wholly constructed of luminescent materials such as inorganic phosphor(s). The phosphor may be a continuous or discontinuous layer or coating on the interior or exterior of the shell. Phosphor particles may also be introduced inside the Plasma-shell or embedded within the shell. Luminescent quantum dots may also be incorporated into the shell.

Secondary Electron Emission

The use of secondary electron emission (Townsend coefficient) materials in a plasma display is well known in the prior art and is disclosed in U.S. Pat. No. 3,716,742 (Nakayama et al.). The use of Group IIA compounds including magnesium oxide is disclosed in U.S. Pat. Nos. 3,836,393 and 3,846,171. The use of rare earth compounds in an AC plasma display is disclosed in U.S. Pat. Nos. 4,126,807, 4,126,809, and 4,494,038, all issued to Wedding et al., and incorporated herein by reference. Lead oxide may also be used as a secondary electron material. Mixtures of secondary electron emission materials may be used.

In one embodiment and mode contemplated for the practice of this invention, the secondary electron emission material is magnesium oxide on part or all of the internal surface of a Plasma-shell. The secondary electron emission material may also be on the external surface. The thickness of the magnesium oxide may range from about 250 Angstrom Units to about 10,000 Angstrom Units (Å).

The entire Plasma-shell may be made of a secondary electronic material such as magnesium oxide. A secondary electron material may also be dispersed or suspended as particles within the ionizable gas such as with a fluidized bed. Phosphor particles may also be dispersed or suspended in the gas such as with a fluidized bed, and may also be added to the inner or external surface of the Plasma-shell.

Magnesium oxide increases the ionization level through secondary electron emission that in turn leads to reduced gas discharge voltages. In one embodiment, the magnesium oxide is on the inner surface of the Plasma-shell and the phosphor is located on external surface of the Plasma-shell.

Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a Plasma-shell minimizes exposure of the magnesium oxide to contamination.

The magnesium oxide may be applied to the inside of the Plasma-shell by incorporating magnesium vapor as part of the ionizable gases introduced into the Plasma-shell while the microsphere is at an elevated temperature. The magnesium may be oxidized while at an elevated temperature.

In some embodiments, the magnesium oxide may be added as particles to the gas. Other secondary electron materials may be used in place of or in combination with magnesium oxide. In one embodiment hereof, the secondary electron material such as magnesium oxide or any other selected material such as magnesium to be oxidized in situ is introduced into the gas by means of a fluidized bed. Other materials such as phosphor particles or vapor may also be introduced into the gas with a fluid bed or other means.

Ionizable Gas

The hollow Plasma-shell as used in the practice of this invention contain(s) one or more ionizable gas components. In the practice of this invention, the gas is selected to emit photons in the visible, IR, and/or UV spectrum.

The UV spectrum is divided into regions. The near UV region is a spectrum ranging from about 340 nm to 450 nm (nanometers). The mid or deep UV region is a spectrum ranging from about 225 mm to 325 nm. The vacuum UV region is a spectrum ranging from about 100 nm to 200 nm. The PDP prior art has used vacuum UV to excite photoluminescent phosphors. In the practice of this invention, it is contemplated using a gas which provides UV over the entire spectrum ranging from about 100 nm to about 450 nm. The PDP operates with greater efficiency at the higher range of the UV spectrum, such as in the mid UV and/or near UV spectrum. In one preferred embodiment, there is selected a gas which emits gas discharge photons in the near UV range. In another embodiment, there is selected a gas which emits gas discharge photons in the mid UV range. In one embodiment, the selected gas emits photons from the upper part of the mid UV range through the near UV range, about 225 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof.

Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, isotopes of oxygen such as oxygen-18. Other isotopes include deuterated gases such as deuterated ammonia ($ND_3$) and deuterated silane ($SiD_4$).

In one embodiment, a two-component gas mixture is used such as a mixture of argon and xenon, argon and helium, xenon and helium, neon and argon, neon and xenon, neon and helium, neon and krypton, helium and krypton, argon and krypton, and xenon and krypton.

In some embodiments, beneficial quantities of radon may be added to mixtures of rare gases, excimers, and other gases including two, three, four, or more component gases.

Specific two-component gas mixtures (compositions) include about 5% to 90% atoms of argon with the balance xenon.

Another two-component gas mixture is a mother gas of neon containing 0.05% to 15% atoms of xenon, argon, or krypton. This can also be a three-component, four-component gas, or five-component gas by using small quantities of an additional gas or gases selected from xenon, argon, krypton, and/or helium. In some embodiments, radon may be added in beneficial amounts to enhance gas conditioning or priming and to achieve other desired results.

In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon; krypton-neon-xenon; and krypton-helium-xenon; argon-xenon-krypton; argon-xenon-helium; and neon-krypton-helium.

U.S. Pat. No. 4,081,712 (Bode et al.), incorporated by reference, discloses the addition of helium to a gaseous medium of 90% to 99.99% atoms of neon and 10% to 0.01% atoms of argon, xenon, and/or krypton.

In one embodiment there is used a high concentration of helium with the balance selected from one or more gases of neon, argon, xenon, and nitrogen as disclosed in U.S. Pat. No. 6,285,129 (Park) and incorporated herein by reference.

A high concentration of xenon may also be used with one or more other gases as disclosed in U.S. Pat. No. 5,770,921 (Aoki et al.), incorporated herein by reference.

Pure neon may be used and the Plasma-shells operated without memory margin using the architecture disclosed by U.S. Pat. No. 3,958,151 (Yano) discussed above and incorporated by reference.

Excimers

Excimer gases may also be used as disclosed in U.S. Pat. Nos. 4,549,109 (Nighan et al.) and 4,703,229 (Nighan et al.), both incorporated herein by reference. Nighan et al. ('109) and ('229) disclose the use of excimer gases formed by the combination of halogens with rare gases. The halogens include fluorine, chlorine, bromine. and iodine. The rare gases include helium, xenon, argon, neon, krypton, and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other Gases

Depending upon the application, a wide variety of gases are contemplated for the practice of this invention. Such other applications include gas-sensing devices for detecting radiation and radar transmissions. Such other gases include $C_2H_2$—$CF_4$—Ar mixtures as disclosed U.S. Pat. Nos. 4,201,692 (Christophorou et al.) and 4,309,307 (Christophorou et al.), both incorporated herein by reference. Also contemplated are gases disclosed in U.S. Pat. No. 4,553,062 (Ballon et al.), incorporated by reference. Other gases include sulfur hexafluoride, HF, $H_2S$, $SO_2$, SO, $H_2O_2$, and so forth.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure.

In the practice of this invention, the gas pressure inside of the hollow Plasma-shell may be equal to or less than atmospheric pressure or may be equal to or greater than atmospheric pressure. The typical sub-atmospheric pressure is about 150 to 760 Torr. However, pressures above atmospheric may be used depending upon the structural integrity of the Plasma-shell.

In one embodiment of this invention, the gas pressure inside of the Plasma-shell is equal to or less than atmospheric, about 150 to 760 Torr, typically about 350 to about 650 Torr.

In another embodiment of this invention, the gas pressure inside of the Plasma-shell is equal to or greater than atmospheric. Depending upon the structural strength of the Plasma-shell, the pressure above atmospheric may be about 1 to 250 atmospheres (760 to 190,000 Torr) or greater. Higher gas pressures increase the luminous efficiency of the plasma display.

Gas Processing

This invention avoids the costly prior art gas filling techniques used in the manufacture of gas discharge (plasma) display devices. The prior art introduces gas through one or more apertures into the device requiring a gas injection hole and tube. The prior art manufacture steps typically include heating and baking out the assembled device (before gas fill) at a high-elevated temperature under vacuum for 2 to 12 hours. The vacuum is obtained via external suction through a tube inserted in an aperture.

The bake out is followed by back fill of the entire panel with an ionizable gas introduced through the tube and aperture. The tube is then sealed-off.

This bake out and gas fill process is a major production bottleneck and yield loss in the manufacture of gas discharge (plasma) display devices, requiring substantial capital equipment and a large amount of process time. For color AC plasma display panels of 40 to 50 inches in diameter, the bake out and vacuum cycle may be 10 to 30 hours per panel or 10 to 30 million hours per year for a manufacture facility producing over 1 million plasma display panels per year.

The gas filled Plasma-shells used in this invention can be produced in large economical volumes and added to the gas discharge (plasma) display device without the necessity of costly bake out and gas process capital equipment. The savings in capital equipment cost and operations costs are substantial. Also the entire PDP does not have to be gas processed with potential yield loss at the end of the PDP manufacture. Each gas filled Plasma-shell can also be batch or separately tested before it is assembled into the PDP.

PDP Structure

In one embodiment, the Plasma-shells are located on or in a single substrate or monolithic PDP structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all cited above and incorporated herein by reference. The Plasma-shells may be positioned on the surface of the substrate and/or positioned in substrate openings such as in channels, trenches, grooves, holes, wells, cavities, hollows, and so forth. These channels, trenches, grooves, holes, wells, cavities, hollows, etc., may extend through the substrate so that the Plasma-shells positioned therein may be viewed from either side of the substrate.

The Plasma-shells may also be positioned on or in a substrate within a dual substrate plasma display structure. Each Plasma-shell is placed inside of a gas discharge (plasma) display device, for example, on the substrate along the channels, trenches, grooves, etc. between the barrier walls of a plasma display barrier structure such as disclosed in U.S. Pat. Nos. 5,661,500 (Shinoda et al.), 5,674,553 (Shinoda et al.), and 5,793,158 (Wedding), cited above and incorporated herein by reference. The Plasma-shells may also be positioned within a cavity, well, hollow, concavity, or saddle of a plasma display substrate, for example as disclosed by U.S. Pat. No. 4,827,186 (Knauer et al.), incorporated herein by reference.

In a device as disclosed by Wedding ('158) or Shinoda et al. ('500), the Plasma-shells may be conveniently added to the substrate cavities and the space between opposing electrodes before the device is sealed. An aperture and tube can be used for bake out if needed of the space between the two opposing substrates, but the costly gas fill operation is eliminated.

In one embodiment, the Plasma-shells are conveniently added to the gas discharge space between opposing electrodes before the device is sealed. The presence of the Plasma-shells inside of the display device adds structural support and integrity to the device. The present color AC plasma displays of 40 to 50 inches are fragile and are subject to breakage during shipment and handling.

The Plasma-shells may be sprayed, stamped, pressed, poured, screen-printed, or otherwise applied to the substrate. The substrate surface may contain an adhesive or sticky surface to bind the Plasma-shell to the substrate.

The practice of this invention is not limited to a flat surface display. The Plasma-shell may be positioned or located on a conformal surface or substrate so as to conform to a predetermined shape such as a curved or irregular surface.

In one embodiment of this invention, each Plasma-shell is positioned within a hole, well, cavity, etc. on a single-substrate or monolithic gas discharge structure that has a flexible or bendable substrate. In another embodiment, the substrate is rigid. The substrate may also be partially or semi-flexible.

Substrate

In accordance with various embodiments of this invention, the PDP may be comprised of a single substrate or dual substrate device with flexible, semi-flexible or rigid substrates. The substrate may be opaque, transparent, translucent, or non-light transmitting. In some embodiments, there may be used multiple substrates of three or more. Substrates may be flexible films, such as a polymeric film substrate. The flexible substrate may also be made of metallic materials alone or incorporated into a polymeric substrate. Alternatively or in addition, one or both substrates may be made of an optically-transparent thermoplastic polymeric material. Examples of suitable such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephihalate, polyethylene terephihalate (PET), polyethylene naphtholate, polycarbonate, polybutylene terephihalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication No. 2004/0179145 (Jacobsen et al.), incorporated herein by reference.

Alternatively, one or both of the substrates may be made of a rigid material. For example, one or both of the substrates may be a glass substrate. The glass may be a conventionally-available glass, for example having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm.

Further details regarding substrates and substrate materials may be found in International Publications Nos. WO 00/46854, WO 00/49421, WO 00/49658, WO 00/55915, and WO 00/55916, the entire disclosures of which are herein incorporated by reference. Apparatus, methods, and compositions for producing flexible substrates are disclosed in U.S. Pat. Nos. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Positioning of Plasma-Shell on Substrate

The Plasma-shell may be positioned or located on the substrate by any appropriate means. In one embodiment of this invention, the Plasma-shell is bonded to the surface of a monolithic or dual-substrate display such as a PDP. The Plasma-shell is bonded to the substrate surface with a non-conductive, adhesive material which may also serve as an insulating barrier to prevent electrically shorting of the conductors or electrodes connected to the Plasma-shell.

The Plasma-shell may be mounted or positioned within a substrate opening such as a hole, well, cavity, hollow, or like depression. The hole, well, cavity, hollow or depression is of suitable dimensions with a mean or average diameter and depth for receiving and retaining the Plasma-shell. As used herein hole includes well, cavity, hollow, depression, or any similar configuration that accepts the Plasma-shell. In U.S. Pat. No. 4,827,186 (Knauer et al.), there is shown a cavity referred to as a concavity or saddle. The depression, well or cavity may extend partly through the substrate, embedded within or extend entirely through the substrate. The cavity may comprise an elongated channel, trench, or groove extending partially or completely across the substrate.

The electrodes must be in direct contact with each Plasma-shell. An air gap between an electrode and the Plasma-shell will cause high operating voltages. As disclosed herein, an electrically conductive adhesive and/or an electrically conductive filler is used to bridge or connect each electrode to Plasma-shell. Such conductive material must be carefully applied so as to not electrically short the electrode to other nearby electrodes.

As disclosed herein, an insulating barrier structure such as a wall or dam is provided to prevent the flow and/or wicking and the shorting of the electrically conductive substance. The insulating barrier structure may comprise any suitable non-conductive material such as a dielectric and may also be an adhesive to bond the Plasma-shell to the substrate. A clearance space may also be used in combination with the insulating barrier structure.

In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Light Barriers

Light barriers of opaque, translucent, or non-transparent material may be located between Plasma-shells to prevent optical cross-talk between Plasma-shells, particularly between adjacent Plasma-shells. A black material such as carbon filler is typically used. This barrier may also serve as an insulating structure to prevent the flow and/or wicking and shorting of electrode materials.

Electrodes

One or more hollow Plasma-shells containing the ionizable gas are located within the display panel structure, each Plasma-shell being in contact with at least two electrodes. In accordance with this invention, the contact is made by an electrically conductive bonding substance applied to each shell so as to form an electrically conductive pad for connection to the electrodes. A dielectric barrier substance may also be used in lieu of or in addition to the conductive substance. Each electrode pad may partially cover the outside shell surface of the Plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zig zag, serpentine, or like pattern as typically used in dot-matrix gas discharge (plasma) displays. The use of split or divided electrodes is contemplated as disclosed in U.S. Pat. Nos. 3,603,836 (Grier) and 3,701,184 (Grier), incorporated herein by reference. Apertured electrodes may be used as disclosed in U.S. Pat. Nos. 6,118,214 (Marcotte) and 5,411,035 (Marcotte) and U.S. Patent Application Publication No. 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the Plasma-shell.

The electrode array may be divided into two portions and driven from both sides with a dual scan architecture as disclosed by Dr. Thomas J. Pavliscak in U.S. Pat. Nos. 4,233,623 and 4,320,418, both incorporated herein by reference.

Transparent tin oxide electrodes can be formed using the processes disclosed by Bernard Feldman and Douglas McLean in U.S. Pat. Nos. 5,976,396 (McLean et al.), 5,986,391 (Feldman), 6,174,452 (McLean et al.), 6,180,021 (McLean et al.), 6,193,901 (McLean et al.), 6,749,766 (McLean et al.), and U.S. Patent Application Publication Nos. 2003/0136755 (McLean et al.), and 2004/0045930 (McLean et al.), all incorporated herein by reference.

A flat Plasma-shell surface is particularly suitable for connecting electrodes to the Plasma-sphere. If one or more electrodes connect to the bottom of the Plasma-shell, a flat bottom surface is desirable. Likewise, if one or more electrodes connect to the top or sides of the Plasma-shell, it is desirable for the connecting surface of such top or sides to be flat.

The electrodes may be applied to the substrate or to the Plasma-shells by thin film methods such as vapor phase deposition, e-beam evaporation, sputtering, conductive doping, etc. or by thick film methods such as screen printing, ink jet printing, etc.

In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow Plasma-shell containing ionizable gas is positioned in the gas discharge (plasma) display device at the intersection of at least two opposing electrodes. When an appropriate voltage potential is applied to an opposing pair of electrodes, the ionizable gas inside of the Plasma-shell at the crossover is energized and a gas discharge occurs. Photons of light in the visible and/or invisible range are emitted by the gas discharge. These may be used to excite a luminescent material located inside or outside the shell of the Plasma-shell.

Shell Geometry

The shell of the Plasma-shells may be of any suitable volumetric shape or geometric configuration to encapsulate the ionizable gas independently of the PDP or PDP substrate. The volumetric and geometric shapes of the Plasma-shell include but are not limited to disc, dome, spherical, oblate spheroid, prolate spheroid, capsular, elliptical, ovoid, egg shape, bullet shape, pear and/or tear drop. In an oblate spheroid, the diameter at the polar axis is flattened and is less than the diameter at the equator. In a prolate spheroid, the diameter at the equator is less than the diameter at the polar axis such that the overall shape is elongated. Likewise, the shell cross-section along any axis may be of any suitable geometric design including circular, elliptical, polygonal, and so forth.

The diameter of the Plasma-shells used in the practice of this invention may vary over a wide range. In a gas discharge display, the average diameter of a Plasma-shell is about 1 mil to 20 mils (where one mil equals 0.001 inch) or about 25 microns to 500 microns where 25.4 microns (micrometers) equals 1 mil or 0.001 inch. Plasma-shells can be manufactured up to 80 mils or about 2000 microns in diameter or greater. The thickness of the wall of each hollow Plasma-shell must be sufficient to retain the gas inside, but thin enough to allow passage of photons emitted by the gas discharge. The wall thickness of the Plasma-shell should be kept as thin as practical to minimize photon absorption, but thick enough to retain sufficient strength so that the Plasma-shells can be easily handled and pressurized.

Typically the Plasma-shell shell thickness is about 1 to 20% of the external width or diameter of the tube shell.

The average diameter of the Plasma-shells may be varied and selected for different phosphors to achieve color balance. Thus for a gas discharge display having phosphors which emit red, green, and blue light in the visible range, the Plasma-shells for the red phosphor may have an average diameter less than the average diameter of the Plasma-shells for the green or blue phosphor. Typically the average diameter of the red phosphor Plasma-shells is about 80% to 95% of the average diameter of the green phosphor Plasma-shells.

The average diameter of the blue phosphor Plasma-shells may be greater than the average diameter of the red or green phosphor Plasma-shells. Typically the average Plasma-shell diameter for the blue phosphor is about 105% to 125% of the average Plasma-shell diameter for the green phosphor and about 110% to 155% of the average diameter of the red phosphor.

In another embodiment using a high brightness green phosphor, the red and green Plasma-shell may be reversed such that the average diameter of the green phosphor Plasma-shell is about 80% to 95% of the average diameter of the red phosphor Plasma-shell. In this embodiment, the average diameter of the blue Plasma-shell is 105% to 125% of the average Plasma-shell diameter for the red phosphor and about 110% to 155% of the average diameter of the green phosphor.

The red, green, and blue Plasma-shells may also have different size diameters so as to enlarge voltage margin and improve luminance uniformity as disclosed in U.S. Patent Application Publication 2002/0041157 A1 (Heo), incorporated herein by reference. The widths of the corresponding electrodes for each RGB Plasma-shell may be of different dimensions such that an electrode is wider or more narrow for a selected phosphor as disclosed in U.S. Pat. No. 6,034,657 (Tokunaga et al.), incorporated herein by reference. There also may be used combinations of different geometric shapes for different colors. Thus there may be used a square cross section Plasma-shell for one color, a circular cross-section for another color, and another geometric cross section such as triangular for a third color. A combination of Plasma-shells of different geometric shapes may be used such as Plasma-sphere and Plasma-disc, Plasma-sphere and Plasma-dome, Plasma-disc and Plasma-dome, or Plasma-sphere, Plasma-disc, and Plasma-dome. Multiple Plasma-shells of one color may be used such as two or more consecutive Plasma-shells of blue, red, or green. In such embodiment, there may be two or more Plasma-shells of one color such as blue while there are fewer Plasma-shells of the other colors. One embodiment comprises three blue, two green, and one red Plasma-shell. Another is two blue, one green, and one red.

Organic Luminescent Substance

Organic and/or inorganic luminescent substances may be used in the practice of this invention. The organic luminescent substance may be used alone or in combination with an inorganic luminescent substance.

In accordance with one embodiment of this invention, an organic luminescent substance is located in close proximity to the enclosed gas discharge within a Plasma-shell, so as to be excited by photons from the enclosed gas discharge.

In accordance with one preferred embodiment of this invention, an organic photoluminescent substance is positioned on at least a portion of the external surface of a Plasma-shell, so as to be excited by photons from the gas discharge within the Plasma-shell, such that the excited photoluminescent substance emits visible and /or invisible light.

As used herein organic luminescent substance comprises one or more organic compounds, monomers, dimers, trimers, polymers, copolymers, or like organic materials which emit visible and/or invisible light when excited by photons from the gas discharge inside of the Plasma-shell.

Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants and/or any other organic photoluminescent material. All are collectively referred to herein as organic photoluminescent phosphor.

Organic photoluminescent phosphor substances contemplated herein include those organic light emitting diodes or devices (OLED) and organic electroluminescent (EL) materials which emit light when excited by photons from the gas discharge of a gas plasma discharge.

Inorganic Luminescent Substances

Inorganic luminescent substances may be used alone or in combination with organic luminescent substances.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb.

In one mode and embodiment of this invention using a green light-emitting phosphor, there is used a green light-emitting phosphor selected from the zinc orthosilicate phosphors such as $ZnSiO_4:Mn^{2+-}$. Green light emitting zinc orthosilicates including the method of preparation are disclosed in U.S. Pat. No. 5,985,176 (Rao) which is incorporated herein by reference. These phosphors have a broad emission in the green region when excited by 147 nm and 173 nm (nanometers) radiation from the discharge of a xenon gas mixture.

In another mode and embodiment of this invention there is used a green light-emitting phosphor which is a terbium activated yttrium gadolinium borate phosphor such as (Gd, Y) $BO_3:Tb^{3+}$. Green light-emitting borate phosphors including the method of preparation are disclosed in U.S. Pat. No. 6,004,481 (Rao) which is incorporated herein by reference.

In another mode and embodiment there is used a manganese activated alkaline earth aluminate green phosphor as disclosed in U.S. Pat. No. 6,423,248 (Rao), peaking at 516 nm when excited by 147 and 173 nm radiation from xenon. The particle size ranges from 0.05 to 5 microns. Rao ('248) is incorporated herein by reference Terbium doped phosphors may emit in the blue region especially in lower concentrations of terbium. For some display applications such as television, it is desirable to have a single peak in the green region at 543 nm. By incorporating a blue absorption dye in a filter, any blue peak can be eliminated.

Green light-emitting terbium-activated lanthanum cerium orthophosphate phosphors are disclosed in U.S. Pat. No. 4,423,349 (Nakajima et al.), incorporated herein by reference. Green light-emitting lanthanum cerium terbium phosphate phosphors are disclosed in U.S. Pat. No. 5,651,920 (Chau et al.), incorporated herein by reference.

Green light-emitting phosphors may also be selected from the trivalent rare earth ion-containing aluminate phosphors as disclosed in U.S. Pat. No. 6,290,875 (Oshio et al.).

Blue Phosphor

A blue light-emitting phosphor may be used alone or in combination with other light-emitting phosphors such as green or red. Phosphor materials which emit blue light include ZnS:Ag, ZnS:Cl, and CsI:Na.

In a preferred mode and embodiment of this invention, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry.

BAM and other aluminate phosphors which emit blue visible light are disclosed in U.S. Pat. Nos. 5,611,959 (Kijima et al.) and 5,998,047 (Bechtel et al.), both incorporated herein by reference. The aluminate phosphors may also be selectively coated as disclosed by Bechtel et al. ('047).

Blue light-emitting phosphors may be selected from a number of divalent europium-activated aluminates such as disclosed in U.S. Pat. No. 6,096,243 (Oshio et al.) incorporated herein by reference.

The preparation of BAM phosphors for a PDP is also disclosed in U.S. Pat. No. 6,045,721 (Zachau et al.), incorporated herein by reference.

In another mode and embodiment of this invention, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. No. 5,989,454 (Rao) which is incorporated herein by reference.

In a best mode and embodiment of this invention using a blue-emitting phosphor, a mixture or blend of blue emitting phosphors is used such as a blend or complex of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference.

Stable blue phosphors of divalent europium activated alkaline earth halide aluminate phosphors are disclosed in U.S. Pat. Nos. 6,660,186 (Rao) and 6,830,706 (Rao), both of which are incorporated herein by reference.

Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference.

Other blue light-emitting phosphors include europium activated strontium chloroapatite and europium-activated strontium calcium chloroapatite.

Red Phosphor

A red light-emitting phosphor may be used alone or in combination with other light-emitting phosphors such as green or blue. Phosphor materials which emit red light include $Y_2O_2S:Eu$ and $Y_2O_3S:Eu$.

In a best mode and embodiment of this invention using a red-emitting phosphor, there is used a red light-emitting phosphor which is an europium activated yttrium gadolinium borate phosphors such as $(Y,Gd)BO_3:Eu^{3+}$. The composition and preparation of these red-emitting borate phosphors is disclosed in U.S. Pat. Nos. 6,042,747 (Rao) and 6,284,155 (Rao), both incorporated herein by reference.

These europium activated yttrium, gadolinium borate phosphors emit an orange line at 593 nm and red emission lines at 611 and 627 nm when excited by 147 nm and 173 nm UV radiation from the discharge of a xenon gas mixture. For television (TV) applications, it is preferred to have only the red emission lines (611 and 627 nm). The orange line (593 nm) may be minimized or eliminated with an external optical filter.

A wide range of red-emitting phosphors are used in the PDP industry and are contemplated in the practice of this invention including europium-activated yttrium oxide.

Other Phosphors

There also may be used phosphors other than red, blue, green such as a white light-emitting phosphor, pink light-emitting phosphor or yellow light-emitting phosphor. These may be used with an optical filter.

Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$.

White-emitting phosphors are disclosed in U.S. Pat. No. 6,200,496 (Park et al.) incorporated herein by reference.

Pink-emitting phosphors are disclosed in U.S. Pat. No. 6,200,497 (Park et al.) incorporated herein by reference. Phosphor material which emits yellow light include ZnS:Au.

SELECTED EMBODIMENTS

In one embodiment contemplated in the practice of this invention, a layer, coating, or particles of luminescent substance such as phosphor is located on the exterior wall of the Plasma-shell. The photons of light pass through the shell or wall(s) of the Plasma-shell and excite the organic and/or inorganic photoluminescent phosphor located outside of the Plasma-shell.

The phosphor may be located on the side wall(s) of a slot, channel, barrier, groove, cavity, hole, well, hollow or like structure of the discharge space as disclosed in U.S. Pat. No. 6,864,631 (Wedding), incorporated herein by reference. The gas discharge within the slot, channel, barrier, groove, cavity, hole, well or hollow produces photons that excite the organic and/or inorganic phosphor such that the phosphor emits light in a range visible to the human eye. Typically this is red, blue, or green light. However, phosphors may be used which emit other light such as white, pink, or yellow light. In some embodiments of this invention, the emitted light may not be visible to the human eye.

In one embodiment, the inside of the Plasma-shell contains a secondary electron emitter. Secondary electron emitters lower the breakdown voltage of the gas and provide a more efficient discharge. Plasma displays traditionally use magnesium oxide for this purpose, although other materials may be used including other Group IIA oxides, rare earth oxides, lead oxides, aluminum oxides, and other materials. It may also be beneficial to add luminescent substances such as phosphor to the inside or outside of the Plasma-sphere. In some embodiments, the Plasma-shell may be wholly or partly made of a luminescent material such as phosphor.

In one embodiment and mode hereof, the Plasma-shell material is a metal or metalloid oxide with an ionizable gas of 99.99% atoms of neon and 0.01% atoms of argon or xenon for use in a monochrome PDP. Examples of shell materials include glass, silica, aluminum oxides, zirconium oxides, and magnesium oxides.

In another embodiment, the Plasma-shell contains luminescent substances such as phosphors selected to provide different visible colors including red, blue, and green for use in a full color PDP. The metal or metalloid oxides are typically selected to be highly transmissive to photons produced by the gas discharge especially in the UV range.

In another embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the Plasma-sphere shell. The exterior application may comprise a slurry or tumbling process with curing, typically at low temperatures. Infrared curing can also be used. The luminescent substance may be applied by other methods or processes including spraying, ink jet, screen printing, dipping, and so forth. The luminescent substance may be applied externally before or after the Plasma-sphere is attached to the PDP substrate. As discussed herein, the luminescent substance may be organic and/or inorganic.

As disclosed herein, this invention is not to be limited to the exact forms shown and described because changes and modifications may be made by one skilled in the art within the scope of the following claims.

The invention claimed is:

1. An AC plasma display having a multiplicity of Plasma-shells and having row scan, bulk sustain, and column data electrodes electrically connected to each Plasma-shell, said display being divided into a plurality of Plasma-shell sections $S_1$, $S_2$, $S_n$, each section having a predetermined number of bulk sustain electrodes and row scan electrodes, and electronic circuitry for simultaneously addressing and sustaining the Plasma-shells in at least two different Plasma-shell sections of the AC plasma display and for simultaneously applying a ramp reset voltage to the Plasma-shells in the Plasma-shell sections $S_1$, $S_2$, $S_n$, before the simultaneously addressing and sustaining of the Plasma-shells in said at least two different Plasma-shell sections.

2. The invention of claim 1 wherein the resolution of the plasma display is about 480 to about 1200 row scan electrodes.

3. The invention of claim 1 wherein there are 12 to 17 subfields for a resolution up to about 768 row scan electrodes.

4. The invention of claim 1 wherein the reset comprises a ramp voltage with a positive or negative slope so as to provide a uniform wall charge at all pixels in the PDP.

5. The invention of claim 4 wherein the ramp voltage has a slow rise time such that the background glow from off-pixels is less visible.

6. The invention of claim 5 wherein the reset ramp voltage has a rise time of about 2 to about 8 volts per microsecond.

7. The invention of claim 5 wherein the reset ramp voltage has a rise time below 2 volts per microsecond.

8. The invention of claim 5 wherein the reset ramp voltage has a rise time of about 1 to about 1.5 volts per microsecond.

9. A method for operating a surface discharge AC plasma display having a multiplicity of Plasma-shells and having row scan, bulk sustain, and column data electrodes electrically connected to each Plasma-shell, which method comprises addressing the Plasma-shell in at least one Plasma-shell section $S_1$ of the AC plasma display while simultaneously sustaining the Plasma-shells in at least one other Plasma-shell section $S_2$, each Plasma-shell section having a predetermined number of bulk sustain electrodes and row scan electrodes, a reset voltage being simultaneously applied to the Plasma-shells in each Plasma-shell section $S_1$ and to the Plasma-shells in the Plasma-shell section $S_2$ before the simultaneous addressing of the Plasma-shells in said Plasma-shell section $S_1$ and the simultaneously sustaining of Plasma-shells in said Plasma-shell section $S_2$.

10. The invention of claim 9 wherein the resolution of the plasma display is about 480 to about 1200 row scan electrodes.

11. The invention of claim 9 wherein there are 12 to 17 subfields for a resolution up to about 768 row scan electrodes.

12. The invention of claim 9 wherein the reset comprises a ramp voltage with a positive or negative slope so as to provide a uniform wall charge at all pixels in the PDP.

13. The invention of claim 12 wherein the ramp voltage has a slow rise time such that the background glow from off-pixels is less visible.

14. The invention of claim 12 wherein the reset ramp voltage has a rise time of about 2 to about 8 volts per microsecond.

15. The invention of claim 12 wherein the reset ramp voltage has a rise time below 2 volts per microsecond.

16. The invention of claim 12 wherein the reset ramp voltage has a rise time of about 1 to about 1.5 volts per microsecond.

* * * * *